US012037777B2

(12) United States Patent
Verhoff et al.

(10) Patent No.: US 12,037,777 B2
(45) **Date of Patent: *Jul. 16, 2024**

(54) SYSTEM AND METHOD FOR CONTROLLING AN OPERATIONAL STATUS OF A WASTE DISPOSER

(71) Applicant: InSinkErator LLC, Benton Harbor, MI (US)

(72) Inventors: Clyde C. Verhoff, Fox Point, WI (US); Brandon R. Blanke, West Allis, WI (US); Charles A. Farago, Kenosha, WI (US); Joseph D Rosandich, Greenfield, WI (US)

(73) Assignee: INSINKERATOR LLC, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/094,247

(22) Filed: Jan. 6, 2023

(65) Prior Publication Data

US 2023/0151599 A1 May 18, 2023

Related U.S. Application Data

(63) Continuation of application No. 17/065,137, filed on Oct. 7, 2020, now Pat. No. 11,549,249.
(Continued)

(51) Int. Cl.
*E03C 1/266* (2006.01)
*E03C 1/05* (2006.01)

(52) U.S. Cl.
CPC ..... *E03C 1/2665* (2013.01); *E03C 1/057* (2013.01)

(58) Field of Classification Search
CPC ..... E03C 1/2665; E03C 1/057
(Continued)

(56) References Cited

U.S. PATENT DOCUMENTS 5,721,411 A * 2/1998 Ervin ..... E03C 1/2665 200/83 Z
7,066,415 B2 6/2006 Strutz
(Continued)

FOREIGN PATENT DOCUMENTS

CN 110029710 7/2019

OTHER PUBLICATIONS

U.S. Appl. No. 62/773,508 filed with the U.S. Patent Office on Nov. 30, 2018 (52 pages).
(Continued)

*Primary Examiner* — Huyen D Le
(74) *Attorney, Agent, or Firm* — Amundsen Davis, LLC

(57) ABSTRACT

Systems and methods for controlling an operational status of a waste disposer are disclosed herein. In one example embodiment, a waste disposer assembly includes a waste disposer, a sprayer mechanism, and a switching system. The waste disposer is configured to be supported in relation to a sink. The sprayer mechanism is configured to be supportable in relation to the sink, is coupled at least indirectly to the sink by way of an extendable and retractable linkage, and includes an actuator mechanism that, upon being actuated, causes generation of a control signal. The switching system is supported in relation to the sink, is coupled at least indirectly to each of the sprayer mechanism and disposer, and is configured to operate so that, upon receiving the control signal from the actuator mechanism, a related signal is provided to the disposer causing the disposer to change or take on operational status.

20 Claims, 9 Drawing Sheets

Related U.S. Application Data

(60) Provisional application No. 62/912,418, filed on Oct. 8, 2019.

(58) Field of Classification Search
USPC ..... 4/626; 241/33
See application file for complete search history.

(56) References Cited

U.S. PATENT DOCUMENTS

| | | | | |
|---|---|---|---|---|
| 7,201,337 | B1 | 4/2007 | Feola | |
| 9,752,307 | B2 | 9/2017 | Bewley, Jr. et al. | |
| 10,125,901 | B2 | 11/2018 | Davidson et al. | |
| 10,407,884 | B2 | 9/2019 | Hirsch | |
| 10,920,404 | B2 | 2/2021 | Hirsch | |
| 11,549,249 | B2 * | 1/2023 | Verhoff | E03C 1/044 |
| 2003/0226918 | A1 | 12/2003 | Gerstel | |
| 2006/0011759 | A1 * | 1/2006 | Chavez | B02C 18/24 241/46.013 |
| 2006/0138246 | A1 | 6/2006 | Stowe et al. | |
| 2007/0152074 | A1 | 7/2007 | Stowe et al. | |
| 2010/0102177 | A1 | 4/2010 | Andersen et al. | |
| 2015/0267386 | A1 | 9/2015 | Bewley, Jr. et al. | |
| 2018/0313068 | A1 | 11/2018 | Hirsch | |
| 2019/0133406 | A1 | 5/2019 | Alali et al. | |
| 2019/0210036 | A1 | 7/2019 | Chavez | |
| 2019/0338501 | A1 | 11/2019 | Hirsch | |
| 2020/0171507 | A1 | 6/2020 | Berger et al. | |
| 2020/0284011 | A1 | 9/2020 | Liu | |

OTHER PUBLICATIONS

PCT/US2020/054582 International Search Report and Written Opinion of the International Searching Authority dated Jan. 25, 2021 (11 pages).

Emerson, "Insinkerator/SinkTop Switch—Dual Outlet," website (accessed on Feb. 12, 2019) pp. 1-4, https://insinkerator.emerson.com/en-us/shop/insinkerator/products/garbage-disposals/disposals-accessories/insinkerator-stsdualoutlet (admitted to have been publicly available prior to Oct. 2018 and admitted to be prior art).

Emerson, "Insinkerator, Food Waste Disposers Specifications," brochure (2018) 1 page, H875-1BA-83-10, https://insinkerator.emerson.com/documents/h875-18a-83-10-2018-01-09-en-5072310.pdf (admitted to have been publicly available prior to Oct. 2018 and admitted to be prior art).

Emerson, "Insinkerator, Food Waste Disposers Specifications," brochure (2018) 1 page, H852-18C-45-10, https://insinkerator.emerson.com/documents/specifications-en-4956194.pdf (admitted to have been publicly available prior to Oct. 2018 and admitted to be prior art).

Emerson, "Insinkerator, Food Waste Disposers," installation instructions (2018) 2 pages,, https://insinkerator.emerson.com/documents/installation-guide-en-4956192.pdf (admitted to have been publicly available prior to Oct. 2018 and admitted to be prior art).

Response filed with the European Patent Office on Nov. 28, 2022 in response to Rules 161(1) and 162 Communication (78 pages).

* cited by examiner

SYSTEM AND METHOD FOR CONTROLLING AN OPERATIONAL STATUS OF A WASTE DISPOSER

CROSS-REFERENCE TO RELATED APPLICATION

The present application is a continuation of U.S. patent application Ser. No. 17/065,137, filed Oct. 7, 2020, which claims the benefit of, and priority to, earlier-filed U.S. provisional patent application No. 62/912,418 filed on Oct. 8, 2019 and entitled "SYSTEM AND METHOD FOR CONTROLLING AN OPERATIONAL STATUS OF A WASTE DISPOSER." The entire contents of the earlier-filed United States patent applications are hereby incorporated by reference herein.

FIELD

The present disclosure relates to systems and methods for controlling waste disposers such as food waste disposers and, more particularly, to systems and methods for controlling the operational status, such as the activation (e.g., on or off) status, of such waste disposers.

BACKGROUND

Food waste disposers are used to comminute food scraps into particles small enough to pass through household drain plumbing. When implemented in household environments, such waste disposers can be activated or deactivated (e.g., turned on or off) depending upon whether the waste disposers are coupled to a power supply. The activation status of such waste disposers can be governed for example by the status of a switch as actuated by a user. It is common in many such household environments, in which a waste disposer is mounted at or near the bottom of a sink, for such a switch to be positioned along a wall nearby the sink.

Although such conventional implementations are adequate to enable users to control the activation status of waste disposers in some circumstances, users still can find it inconvenient to control the activation status of waste disposers in other circumstances. For example, the switch governing the supply of power to a waste disposer, when located on a wall nearby a sink, can be inconvenient or even difficult for a user to actuate if the user is standing immediately in front of the sink, or if the user is actively engaged with washing items in the sink such that reaching over to a wall to flip a switch may be inconvenient.

Accordingly, it would be desirable if a new or improved system or method for controlling the activation (e.g., on/off) status or other operational status of a waste disposer could be developed, so as to overcome the inconvenience associated with controlling such a status as can exist in relation to some conventional arrangements as discussed above, or to achieve one or more other additional advantages.

BRIEF SUMMARY

In at least some example embodiments, the present disclosure relates to systems and methods for controlling an operational status of a waste disposer are disclosed herein. In one example embodiment encompassed herein, a waste disposer assembly includes a waste disposer, a sprayer mechanism, and a switching system. The waste disposer is configured to be supported in relation to a sink. The sprayer mechanism is configured to be supportable in relation to the sink, is coupled at least indirectly to the sink by way of an extendable and retractable linkage, and includes an actuator mechanism that, upon being actuated, causes generation of a control signal. The switching system is supported in relation to the sink, is coupled at least indirectly to each of the sprayer mechanism and the waste disposer, and is configured to operate so that, upon receiving the control signal from the actuator mechanism, a related signal is provided to the waste disposer causing the waste disposer to change or take on an operational status.

In an additional example embodiment, the present disclosure relates to a sprayer apparatus configured to allow for controlling an operational status of a waste disposer. The sprayer mechanism includes a wand portion including a housing having a first end and a second end, where the first end of the wand is configured to fit into or in relation to a support element when the sprayer mechanism is in a resting state. The sprayer mechanism also includes a water port provided along the housing, a water hose connection at either the first end or the second end, at least one passage that extends substantially from the water hose connection to the water port, and a water control actuator configured to govern whether water received via the hose connection can proceed fully from the hose connection via the at least one passage to and out the water port. Further, the sprayer mechanism additionally includes an actuator mechanism configured to generate and send a control signal for receipt by at least one receiving device, where the control signal is configured to cause the at least one receiving device to operate to cause the operational status of the waste disposer to change.

In a further example embodiment, the present disclosure relates to a method of controlling an operational status of a waste disposer supported in relation to a sink. The method includes providing a sprayer mechanism configured to be supportable in relation to the sink, and coupled at least indirectly to the sink by way of an extendable and retractable linkage. The method additionally includes moving the sprayer mechanism in relation to the sink, as permitted by the extendable and retractable linkage, so that a water port of the sprayer mechanism is directed in a desired manner, and causing water to be dispensed from the water port of the sprayer mechanism in response to a first actuation of a water control actuator. The method also includes generating a control signal in response to a second actuation of an actuation mechanism, and sending either the control signal or an additional signal based at least indirectly upon the control signal for receipt by at least one receiving device, where the control signal or additional signal that is sent is configured to cause the at least one receiving device to operate to cause the operational status of the waste disposer to change. The method further includes receiving, at the sprayer mechanism, a feedback signal concerning the operational status of the waste disposer, and outputting a light signal from a lighting device on the sprayer mechanism at least indirectly in response to the feedback signal, the light signal being indicative of the operational status of the waste disposer.

BRIEF DESCRIPTION OF THE DRAWINGS

Embodiments of food waste disposer assemblies (or other waste disposer assemblies) including waste disposers, sprayer mechanisms, and associated mechanisms or components for controlling the operational status of such waste disposers are disclosed with reference to the accompanying drawings and are for illustrative purposes only. The waste disposer assembly systems, apparatuses, and methods encompassed herein are not limited in their applications to the details of construction, arrangements of components, or other aspects or features illustrated in the drawings, but rather such systems, apparatuses and methods encompassed herein include other embodiments or are capable of being practiced or carried out in other various ways. Like reference numerals are used to indicate like components. In the drawings.

DETAILED DESCRIPTION

Figure 1:
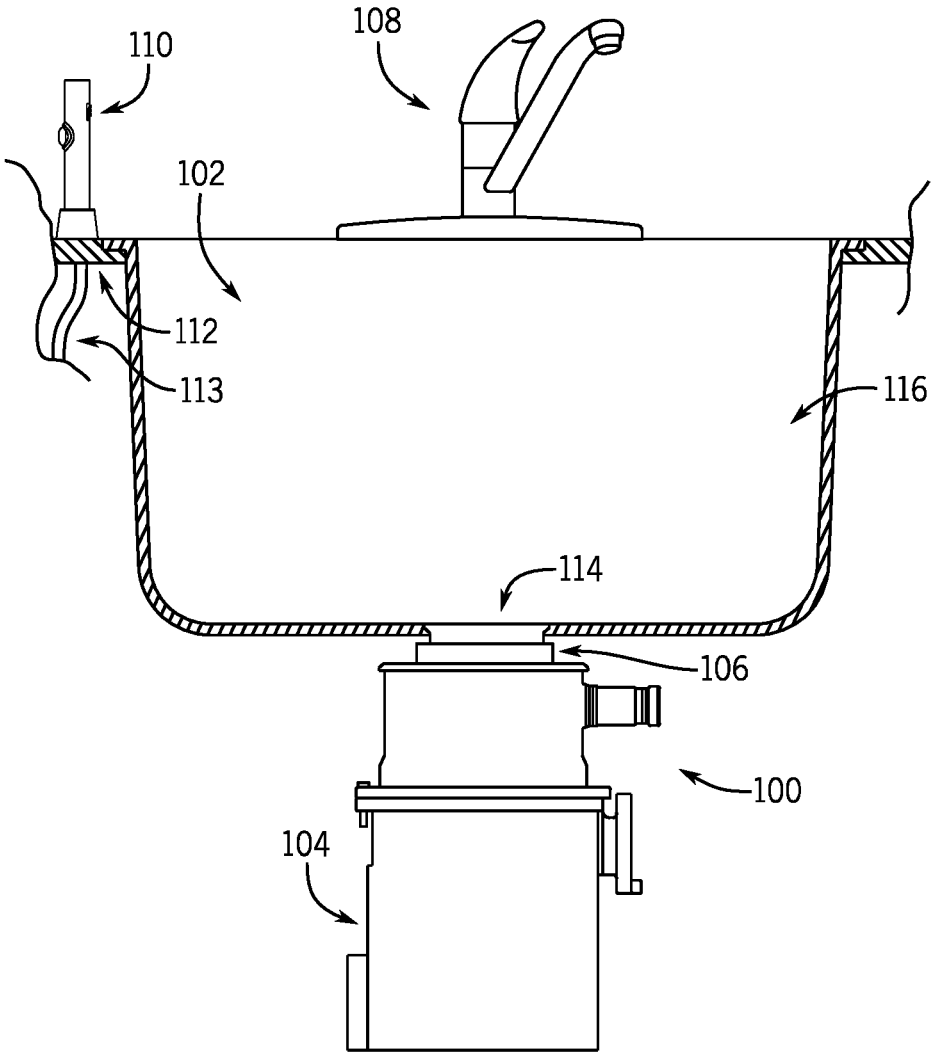
FIG. 1 is a partly cross-sectional, partly front elevation view of an example improved food waste disposer assembly including a food waste disposer mounted in relation to a sink, a sprayer mechanism, and a disposer activation control mechanism associated with the sprayer mechanism, in accordance with an example embodiment encompassed herein.

Referring to FIG. 1, an improved food waste disposer assembly 100 in accordance with an example embodiment encompassed herein includes a sink 102 and a food waste disposer 104 that is mounted to the sink 102 by way of a mounting (or sink flange) assembly 106, which also can be considered part of the food waste disposer 104 itself. Additionally, the food waste disposer assembly 100 includes a faucet 108 and a sprayer mechanism 110, which in this embodiment is positioned along a side edge 112 of the sink 102 and is supplied with water by way of a water hose assembly 113. Although FIG. 1 shows a front elevation view of the food waste disposer 104, a cross-sectional view is provided of the sink 102, so as to better illustrate how the food waste disposer is installed relative to the sink and particularly in relation to a bottom orifice 114 of the sink by way of which water, food, and other material can pass from an interior region 116 of the sink into the food waste disposer 104.

Figure 2A:
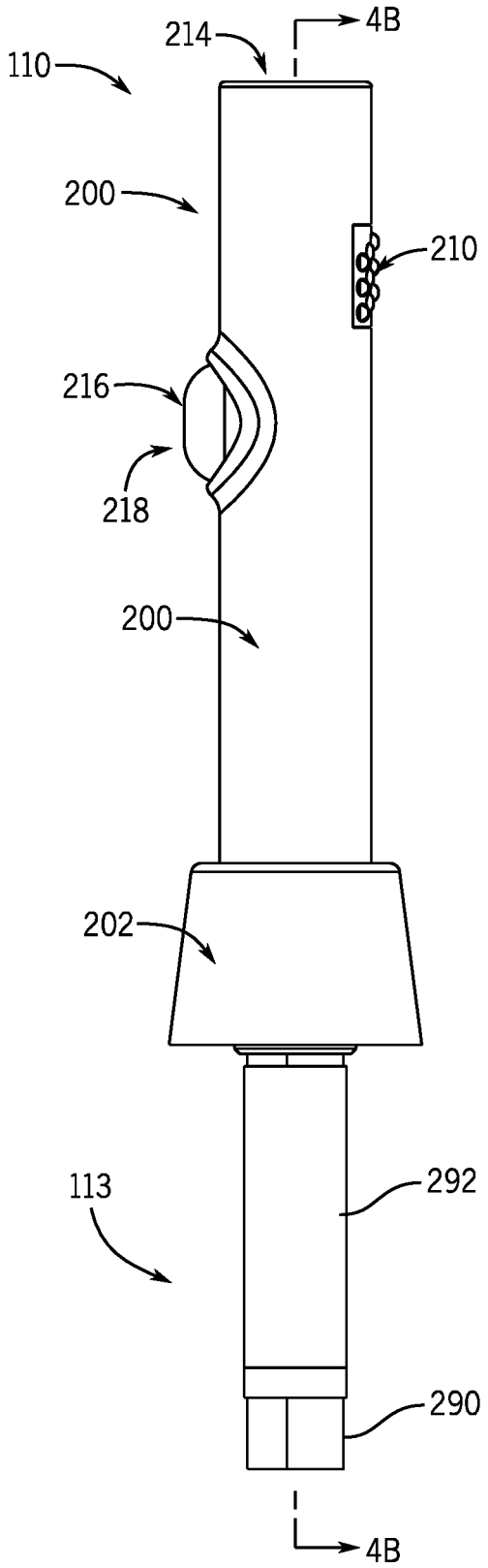
FIG. 2A is a front elevation view of the sprayer mechanism of the food waste disposer assembly of FIG. 1, which in accordance with the present example embodiment includes a disposer activation button, in combination with a cutaway portion of a water hose assembly of the food waste disposer assembly.
Figure 2B:
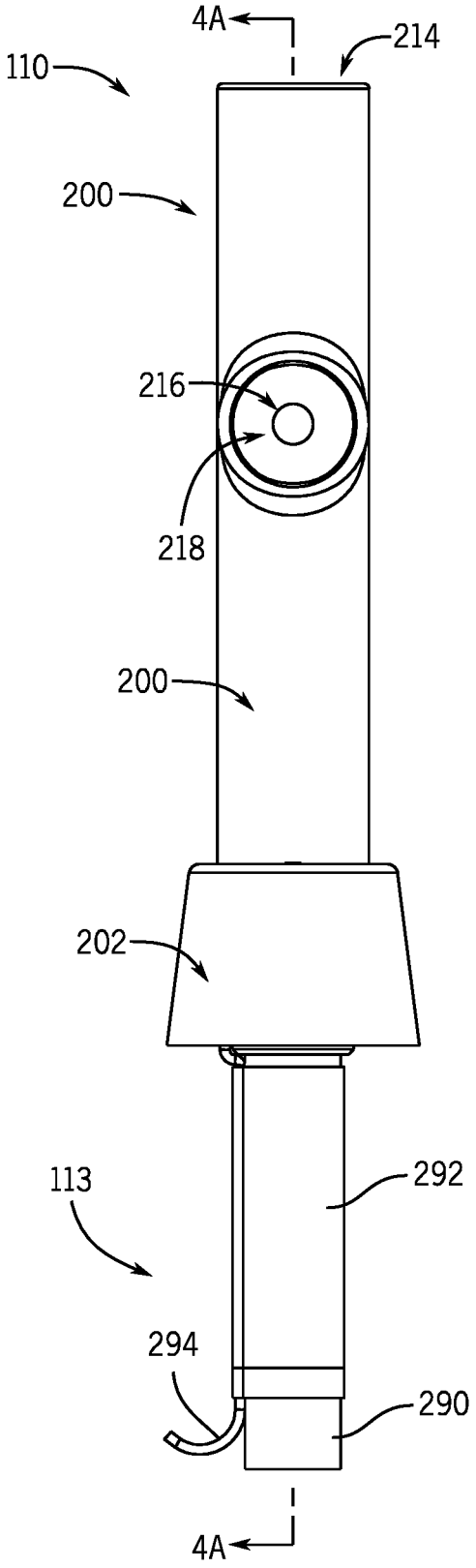
FIG. 2B is a left side elevation view of the sprayer mechanism of the food waste disposer assembly of FIG. 1 and FIG. 2A, again shown in combination with a cutaway portion of the water hose assembly of the food waste disposer assembly.

Referring to FIG. 2A, FIG. 2B, FIG. 3, FIG. 4A, and FIG. 4B, respectively, the sprayer mechanism 110 of FIG. 1 is shown in each of a front elevation view, a left side elevation view, a top perspective view, a cross-sectional view taken along a line 4A-4A of FIG. 2B, and a cross-sectional view taken along a line 4B-4B of FIG. 2A, respectively. As shown, the sprayer mechanism 110 includes an elongated tubular wand 200 and a sprayer base 202. In the present embodiment, it is the base 202 that is directly supported upon the edge 112 of the sink 102. When in a resting configuration, a bottom portion 204 of the wand 200 fits coaxially within, and is supported by, a complementary receiving orifice 206 of the sprayer base 202. When the wand 200 is supported in this manner by the base 202, the wand generally extends substantially vertically upward in a direction that is parallel or substantially parallel to a central axis of the orifice 206 (and also, in this embodiment, to a central axis of the orifice 114).

Also, the bottom portion 204 of the wand 200 of the sprayer mechanism 110 includes a sprayer hose connection 215 by which the wand 200 typically (e.g., when the sprayer mechanism 110 is implemented as part of the improved food waste disposer assembly 100) is coupled to the water hose assembly 113 of FIG. 1, by way of which water is provided to the wand 200 of the sprayer mechanism 110. More particularly, as illustrated in each of FIG. 2A, FIG. 2B, FIG. 3, FIG. 4A, and FIG. 4B, the water hose assembly 113 to which the wand 200 is coupled in the present example embodiment includes a flexible water hose 290 that is coaxially or substantially coaxially surrounded by and extends through a wire/hose jacket 292 (the water hose and wire/hose jacket are shown in cutaway). The flexible water hose 200 can extend to a location upstream of the wand 200 (in terms of direction of normal water flow through the hose, toward the wand) at which the hose can be coupled to a water source (not shown). It should be appreciated that, although the water hose assembly 113 is a part of the overall food waste disposer assembly 100 of FIG. 1 and is shown in FIG. 2A, FIG. 2B, FIG. 3, FIG. 4A, and FIG. 4B as being coupled to the sprayer mechanism 110/wand 200, the water hose assembly 113 need not be considered to be a part of the sprayer mechanism (or wand); rather, the sprayer mechanism 110 (and wand 200) can be considered to be distinct from the water hose assembly (albeit, in some cases, the water hose assembly or portions thereof can alternatively be considered to constitute part of the sprayer mechanism or wand).

Figure 4A:
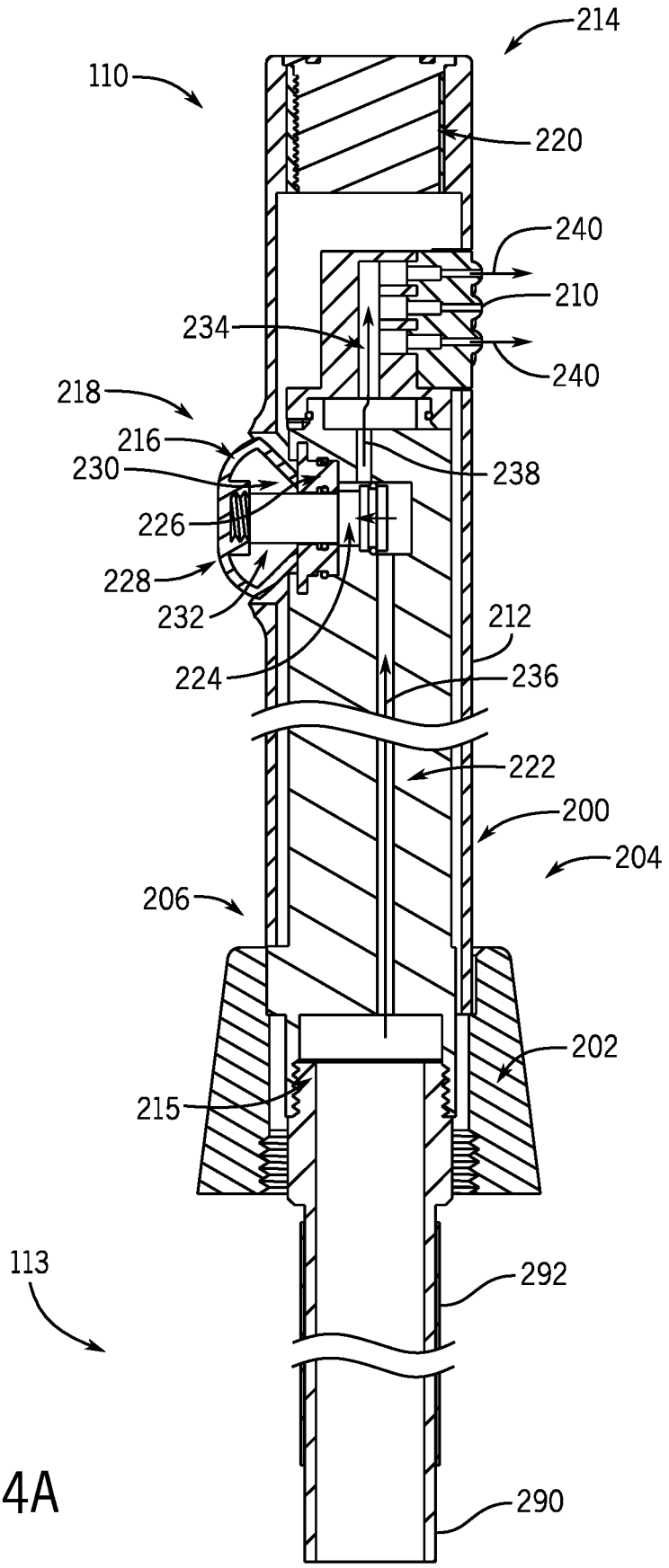
FIG. 4A is a cross-sectional view of the sprayer mechanism and cutaway portion of the water hose assembly of the food waste disposer assembly of FIGS. 1, 2A, 2B, and 3, taken along a line 4A-4A of FIG. 2B (with break lines indicating a portion removed for clarity)
Figure 4B:
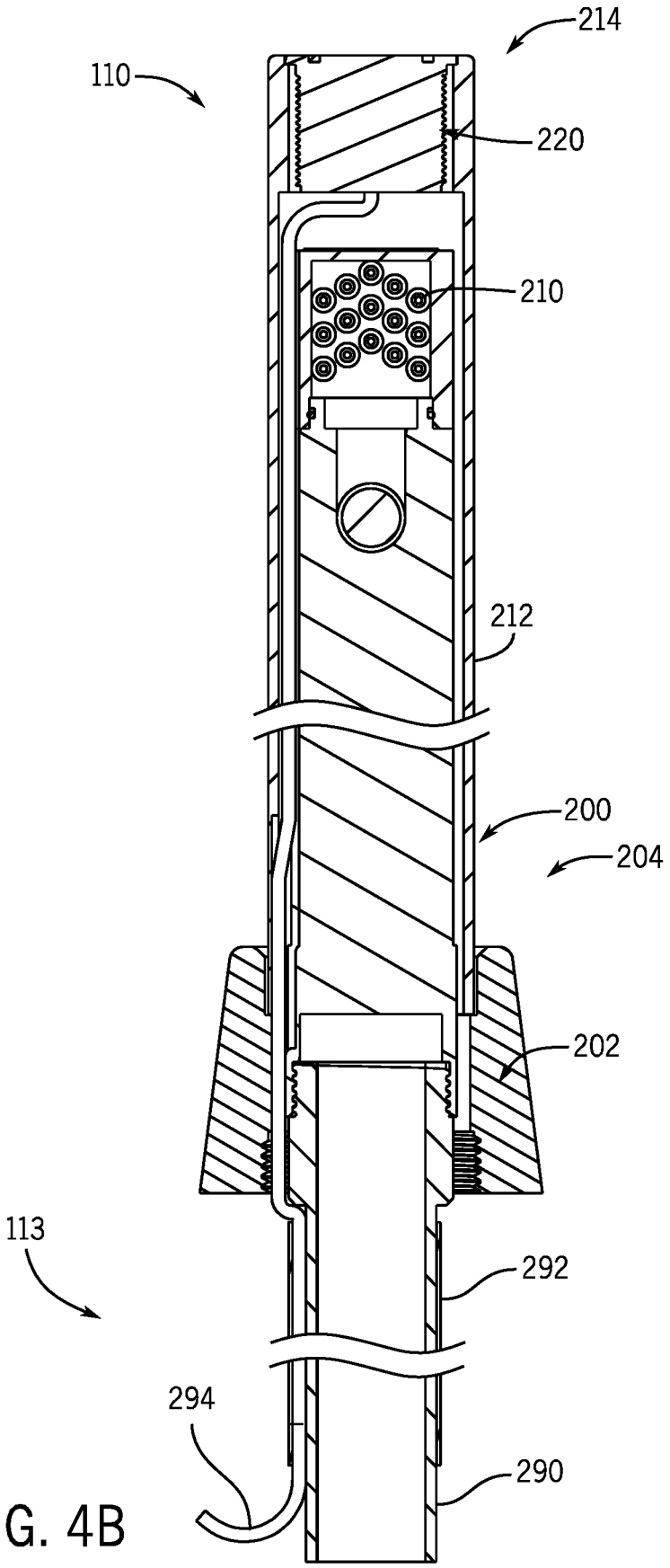
FIG. 4B is a cross-sectional view of the sprayer mechanism and cutaway portion of the water hose assembly of the food waste disposer assembly of FIGS. 1, 2A, 2B, 3 and 4A, taken along a line 4B-4B of FIG. 2A (with break lines indicating a portion removed for clarity)

Additionally in the present embodiment, as particularly illustrated by FIG. 2B and FIG. 4B, electrical communication signals and power can also be sent between the wand 200 of the sprayer mechanism 110 and location(s) separate or remote from the sprayer mechanism by way a power/LED wire 294 (also shown in cutaway) of the water hose assembly 113. As shown, the power/LED wire 294 extends from within the wand 200 and into and through an annular chamber between the outer circumference of the flexible water hose 290 and the wire/hose jacket 292. Within the wire/hose jacket 292, the power/LED wire 294 is able to run alongside the flexible water hose 290 up to a location upstream (in terms of direction of normal water flow through the flexible water hose) of the wand 200 at which the power/LED wire can exit the wire/hose jacket 292 and be coupled to a power source and/or other device(s), for example as described in more detail with respect to FIG. 5 and FIG. 6. Thus, by virtue of the flexible water hose 290 and the power/LED wire 294 extending within the wire/hose jacket 292, respectively, water and electric signals (for power or communication) respectively can be communicated between the wand 200 and location(s) separate or remote from the wand 200.

It will be appreciated that a primary purpose of the sprayer mechanism 110 is to provide a user with the capability of directing water from the sprayer mechanism toward or at one or more target objects, such as dishware, that may be positioned within the interior region 116 of the sink 102, or at regions of the sink itself that require cleaning. To achieve this purpose, the sprayer mechanism 110 includes several components/features. More particularly, the wand 200 of the sprayer mechanism 110 includes a sprayer outlet 210, which in the present embodiment can be a rubber or other flexible material component. As illustrated, the sprayer outlet 210 can be situated at a first location along an outer tubular sprayer housing 212 of the wand 200 that is positioned near, but not at, an upper end 214 of the wand that is generally opposite the location of the bottom portion 204. The sprayer outlet 210 can include any of a variety of nozzle features or other orifices by which water can exit from the wand 200 of the sprayer mechanism 110. Additionally, the wand 200 of the sprayer mechanism 110 also includes a water activation button 216. In the present example embodiment, the water activation button 216 is a bulbous structure that protrudes outward from the sprayer housing 212 at a middle location 218 along that housing between the upper end 214 and the bottom portion 204 (and also between the sprayer outlet 210 and the bottom portion 204 as shown). The water activation button 216 is made from rubber or other flexible material so that a user pressing on the button can deform the button inwardly so as to actuate an internal valve arrangement and cause the sprayer mechanism 110 to dispense water from the sprayer outlet 210 as described further below.

Figure 3:
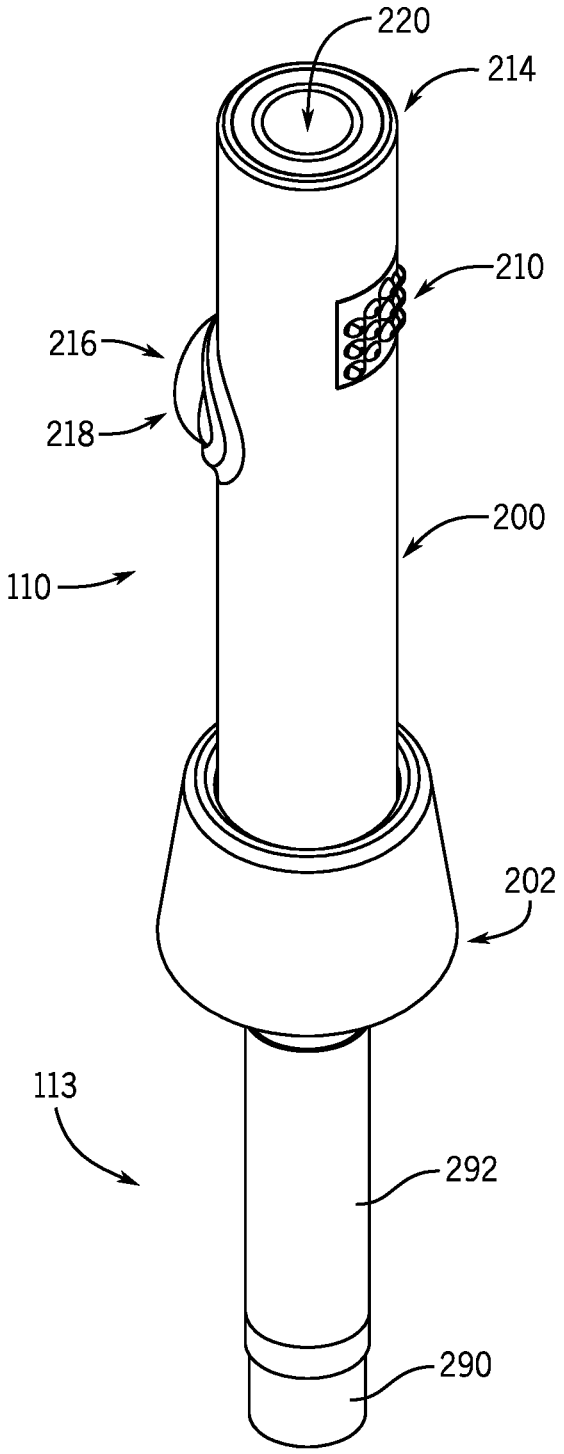
FIG. 3 is a top perspective view of the sprayer mechanism of FIG. 1, FIG. 2A, and FIG. 2B that particularly reveals the disposer activation button at a top end of the sprayer mechanism, again shown in combination with a cutaway portion of the water hose assembly of the food waste disposer assembly.

Further as shown, in the present embodiment the wand 200 of the sprayer mechanism 110 also includes a disposer activation button 220, which is shown in FIG. 3 in particular (but is not visible in FIG. 2A or FIG. 2B). As will be described further below, a user, by pressing or actuating the disposer activation button 220, can control the activation/deactivation status of the food waste disposer 104, e.g., switch on or switch off the food waste disposer. In the present example embodiment, the disposer activation button 220 is located at the upper end 214 of the wand 200 of the sprayer mechanism 110, effectively at the upper tip of the sprayer mechanism. Such positioning of the disposer activation button 220 allows a user to conveniently see and access the disposer activation button 220 even when the sprayer mechanism 110 is not being used, when the wand 200 is resting in the base 202. Also, in at least some versions of the present embodiment, the disposer activation button 220 includes one or more lighting devices (such as light emitting diode(s) 560 shown in FIG. 5) implemented therein or in association therewith, which serve to indicate that the food waste disposer 104 is switched on or switched off based upon whether light is being emitted by those devices or not.

Referring particularly to FIG. 4B, it can be seen that the power/LED wire 294 extends within the interior of the wand 200, within the outer tubular sprayer housing 212 from the bottom portion 204 to the disposer activation button 220 at the upper end 214 of the wand 200. As will be described in further detail below in relation to FIG. 5 and FIG. 6, the power/LED wire 294 allows for electrical signals (e.g., electrical control signals) to be communicated from (and/or to) the disposer activation button 220 to the water hose assembly 113 and thereby to (and/or from) a location outside of the sprayer mechanism 110/wand 200, such as to (and/or from) an electrical circuit located outside of and apart from the sprayer mechanism/wand (e.g., a control printed circuit board at or associated with the food waste disposer 104). Also, the power/LED wire 294 allows for electrical power to be communicated from a location separate or remote from the sprayer mechanism 110/wand 200 to the disposer activation button 220 and/or the one or more lighting devices associated with the disposer activation button within the sprayer mechanism/wand. As mentioned further below, the power/LED wire 294 is intended to be representative of one or more discrete wires or connections, and in some cases can take the form of a bus. Because in the present example embodiment the power/LED wire 294 both runs within the wire/hose jacket 292 of the water hose assembly 113 and also runs within the interior of the wand 200, the power/LED wire 294 and/or portion(s) thereof can be considered to be part of the sprayer mechanism 110 (and/or wand 200), or alternatively considered to be part of the water hose assembly 113 (but not the sprayer mechanism or wand), or alternatively considered to be part(s) of each of the sprayer mechanism (and/or wand) and the water hose assembly.

Additionally, referring particularly to FIG. 4A, several features of the sprayer mechanism 110 are evident from the cross-sectional views that are provided, especially in terms of the manner in which the sprayer mechanism 110 operates to dispense water out of the sprayer outlet 210. As shown in FIG. 4A, a sprayer body conduit 222 is formed within the main sprayer body, within the sprayer housing 212 of the wand 200. When the wand 200 is in the resting position as illustrated in FIGS. 1, 2A, 2B, 3, 4A and 4B, the sprayer body conduit 222 extends upward from the sprayer hose connection 215 to a vertical level corresponding to the middle location 218 of the water activation button 216.

Further as shown in FIG. 4A, at the vertical level of the water activation button 216, the wand 200 of the sprayer mechanism 110 includes, in addition to the water activation button, each of a water path plunger 224, a plunger cap 226, and a spring (not shown). The water activation button 216 covers over and encloses an outermost tip 228 of the water path plunger 224. Although the aforementioned spring is not shown, it should be appreciated that the spring will rest at a spring location 230 between the plunger cap 226 and a receiving location 232 of the water path plunger 224, where the receiving location 232 is positioned between the plunger cap 226 and the water activation button 216. By virtue of this arrangement, the water path plunger 224 is biased by the spring to take on an outward position as shown in FIG. 4A.

Notwithstanding the biasing force provided by the spring, however, when a user presses the water activation button 216 inwardly, the force of the spring is overcome and the water path plunger 224 moves inward relative to the plunger cap 226. In this manner, the water path plunger 224 and plunger cap 226 can be operated as a valve mechanism that is actuated by the water activation button 216.

More particularly, as additionally shown in FIG. 4A, the wand 200 not only includes the sprayer body conduit 222 but also includes a sprayer outlet channel 234 positioned above the location of the water path plunger 224 and linking that location with the sprayer outlet 210 (see also FIG. 4B). Given this arrangement, when the water path plunger 224 is moved (e.g., by the spring) to its outermost position as shown in FIG. 4A, the water path plunger tends to prevent water from flowing from the sprayer body conduit 222 vertically upward past the water path plunger into the sprayer outlet channel 234 and ultimately to and out of the sprayer outlet 210. However, when the water path plunger 224 is moved inwardly due to actuation of the water activation button 216, water is able to proceed from the sprayer hose connection 215 through the sprayer body conduit 222 to the water path plunger as indicated by a first arrow 236, past the water path plunger, into and through the sprayer outlet channel 234 as indicated by a second arrow 238, and ultimately to and out of the sprayer outlet 210 as indicated by third arrows 240.

Although not evident from FIGS. 1, 2A, 2B, 3, 4A, and 4B, it should be appreciated that the sprayer mechanism 110 particularly is designed to allow for a user to move the wand 200 away from its resting position relative to the base 202 as illustrated in FIG. 1, upward and outward away from the base 202, as well as around to different locations within and about the sink 102. The movement of the wand 200 can entail each of vertical movements, horizontal movements, and rotational movements so as to adjust the location of the sprayer outlet 210 as well as adjust the orientation of the sprayer outlet so as to vary the direction of water flow toward the sink 102 and/or towards other structures that may be within or about the sink (including locations outside of the sink).

To facilitate such movement of the wand 200 and still allow for water to be provided to the wand from another location associated with the sink (e.g., a location under the sink from which water can be sourced for purposes of the sprayer mechanism 110 and the faucet 108), the sprayer hose connection 215 shown in FIGS. 4A and 4B is coupled not to a fixed location on the base 202 but rather is coupled to an end of the water hose assembly 113 (e.g., as shown in FIGS. 1, 2A, 2B, and 3) and particularly the flexible water hose 290 thereof. Depending upon the embodiment, each of the flexible water hose 290 and the wire/hose jacket 292 of the water hose assembly 113 can be made of a rubber or other flexible material, and will extend some length (e.g., several feet) beneath the base 202 and beneath the edge 112 of the sink 102 on which the base 202 is positioned. Likewise, the power/LED wire 294 can be made of flexible material(s) and extend some length (e.g., several feet) beneath the base 202 and beneath the edge 112 of the sink 102. It should be appreciated that, when the wand 200 is raised out of the base 202, away from the resting position illustrated by FIG. 1, then the bottom portion 204 continues to be coupled to a water source because the sprayer hose connection 215 links the wand with that water source by way of the water hose assembly 113, which typically will be arranged so as to extend out of the base 202 to greater distances as the wand 200 is moved farther from the base, and to retract back through the base when the wand is moved closer to the base or returned to its resting position.

As already mentioned, in the present embodiment, the sprayer mechanism 110 not only allows a user to control the dispensing of water out of the sprayer mechanism by way of the sprayer outlet 210, but also affords a user an ability to control the activation/deactivation (e.g., on/off) status of the food waste disposer 104, by way of actuating the disposer activation button 220 on the sprayer mechanism. By virtue of the disposer activation button 220, a user can effectively remotely control the activation/deactivation status of the food waste disposer 104 by way of a switch that is readily accessible to the user and readily visible to the user when the wand 200 of the sprayer mechanism 110 is in its resting position as shown in FIG. 1. Further, the disposer activation button 220 also permits a user to effectively remotely control the activation/deactivation status of the food waste disposer 104 even when the user is utilizing the sprayer mechanism 110, in a convenient manner when the user is holding the wand 200 of the sprayer mechanism.

Figure 5:
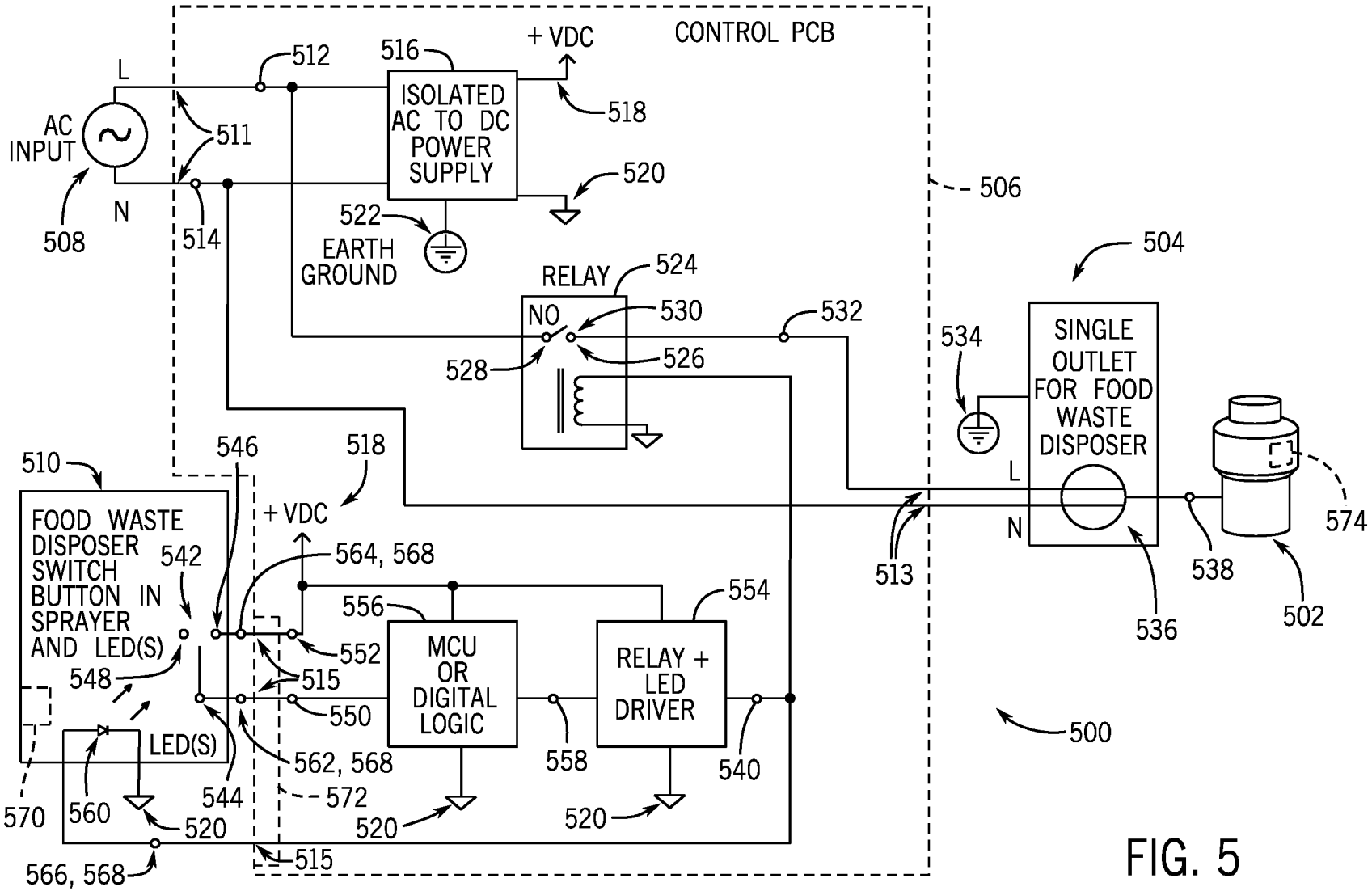
FIG. 5 is an electrical schematic diagram showing an electrical system within the food waste disposer assembly of FIG. 1 that serves as a disposer activation control mechanism.

In order for the disposer activation button 220 to permit user control in relation to the food waste disposer 104, the food waste disposer assembly 100 includes an electrical system 500 as shown by an electrical block (or schematic) diagram in FIG. 5. The electrical system 500 includes multiple electrical components and interconnections that enable the system to serve as a disposer activation control mechanism allowing for the activation/deactivation status of the food waste disposer 104 to be controlled by the disposer activation button 220. As illustrated, the electrical system 500 includes a food waste disposer electrical component 502, which can be representative of an electric motor embedded within the food waste disposer 104, as well as a power outlet 504, control circuitry provided on a control printed circuit board (PCB) 506, an alternating current (AC) power source or input 508, and an actuator circuit 510. Although for simplicity the AC power source 508 is treated as being part of the electrical system 500, it can also be considered to be a component (or system) with respect to which the electrical system 500 is electrically coupled, but that is properly viewed as external or independent from the electrical system 500.

Further as illustrated, the electrical system 500 particularly is arranged so that the control PCB 506 is coupled to each of the AC power source 508, the power outlet 504, and the actuator circuit 510 at first, second, and third ports 511, 513, and 515, respectively. More particularly, the control PCB 506 includes a first link (or connection or wire) 512 and a second link (or connection or wire) 514 that are respectively coupled, via the port 511, with a line (L) lead and a neutral (N) lead of the AC power source 508. Each of the first link 512 and second link 514 in turn is coupled to an isolated AC to DC (Direct Current) power supply 516 within the control PCB 506. As shown, the power supply 516 is coupled to a positive voltage (+VDC) port 518, a ground port 520 and an earth ground port 522. In addition, the second link 514 is also coupled to a neutral (N) lead of the power outlet 504 by way of the port 513. Thus, the voltage at the neutral (N) lead of the AC power source 508 is directly made available at the power outlet 504.

Additionally, the first link 512 is also coupled internally within the control PCB 506 to a relay 524. The relay 524 includes a normally open (NO) switch 526 having a first terminal 528 and a second terminal 530, where it is the first terminal 528 that is particularly coupled to the first link 512. By contrast, the second terminal 530 is coupled by way of a third link 532 to the second port 513 and thereby coupled to the line (L) lead of the power outlet 504. Thus, if the NO switch 526 takes on a closed (short-circuit) status, the AC power from the AC power source 508 is provided via the links 512, 532, and 514 to the second port 513 and thus to the power outlet 504. However if the NO switch 526 has an open status, the AC power from the AC power source 508 cannot reach the second port 513 or the power outlet 504.

Further as shown, the power outlet 504 has an earth ground port 534, and also a single outlet 536 that is coupled to the line (L) and neutral (N) leads of the power outlet 504, and thereby coupled via the second port 513 to the third link 532 and the second link 514. The single outlet 536 is configured to receive a plug of a (grounded 3-wire) power cord 538 of the food waste disposer electrical component 502 so as to couple that power cord to the outlet. When the power cord 538 is coupled to the single outlet 536 in this manner, the food waste disposer electrical component 502 is coupled to the single outlet 536 of the power outlet 504, and thus is electrically coupled to the third link 532 and the second link 514 via the second port 513. Assuming such an arrangement, when the NO switch 526 takes on the closed status, the AC power from the AC power source 508 is provided not only to the power outlet 504 but also to the food waste disposer electrical component 502, such that the food waste disposer 104 is activated/turned on. However, when the NO switch 526 has an open status, then the food waste disposer electrical component 502 does not receive AC power and thus the food waste disposer is deactivated/turned off.

From the above discussion, it should be evident that the food waste disposer electrical component 502 receives or does not receive power, and that the food waste disposer 104 is turned on or off, depending upon the closed or open status of the NO switch 526. In the present embodiment, the status of the NO switch 526 is governed by additional components of the control PCB 506, which operate in response to actuation signals from the actuator circuit 510 corresponding to the disposer activation button 220. More particularly, whether the NO switch 526 is opened or closed depends upon whether voltage is communicated to the relay 524 by way of a fourth link 540. When a non-zero voltage is provided by the fourth link 540 to the relay 524, then the NO switch 526 takes on a closed status, but otherwise, in the absence of such a voltage being provided, the NO switch takes on an open status.

Further as shown in FIG. 5, the providing of any voltage by way of the fourth link 540 is determined based upon several additional circuit components within the control PCB 506, which in turn operate based upon the actuation signals received from the actuator circuit 510 via the third port 515. More particularly, in the present embodiment, the actuator circuit 510 includes a switch 542 having first, second, and third terminals 544, 546, and 548, respectively. The first terminal 544 of the switch 542 is coupled to a fifth link 550 of the control PCB 506 by way of the third port 515, the second terminal 546 of the switch 542 is coupled to a sixth link 552 of the control PCB 506 by way of the third port 515, and the third terminal 548 is a floating terminal. Pressing of the disposer activation button 220 causes the switch 542 to take on a closed position such that the first and second terminals 544 and 546 are directly coupled (short-circuited) relative to one another. However, when the disposer activation button 220 is not pressed, then the first and second terminals 544 and 546 are no longer coupled (in such case, it can be assumed that the first and third terminals 544 and 548 are short-circuited together).

Additionally as shown, the control PCB 506 additionally includes a relay and LED (light emitting diode) driver circuit 554 and a control circuit 556, which can for example take the form of a MCU (microcontroller unit) or a digital logic circuit (although in other embodiments the control circuit can take other forms, such as a microprocessor). The control circuit 556 is coupled to the driver circuit 554 by way of a seventh link 558, by way of which the control circuit is able to provide control signals to the driver circuit 554, and additionally the fourth link 540 is coupled to the driver circuit 554. Further, the fifth link 550 is coupled to the control circuit 556, and the sixth link 552 is coupled to each of the control circuit 556, the driver circuit 554, and to the positive DC voltage (+VDC) port 518, and each of the control circuit 556 and driver circuit 554 is also coupled to the ground port 520.

Given this arrangement, actuation (e.g., pressing) of the disposer activation button 220 governs the closed or open status of the NO switch as follows. The control circuit 556 can operate as a toggling mechanism such that it will provide a non-zero control signal (e.g., a non-zero voltage signal) to the driver circuit 554 via the seventh link 558 up until such time as it receives an actuation signal (e.g., a positive voltage pulse signal) via the fifth link 550, and then will switch to providing no control signal (e.g., a zero voltage signal) to the driver circuit via the seventh link up until such time as it receives another actuation signal via the fifth link, and vice-versa. The driver circuit 554 in turn can provide voltage signals to the fourth link 540 for communication to the relay 524 based directly upon the control signals received from the control circuit 556. (Also, it will be appreciated that the control circuit 556 can be set to have an initial output state, e.g., the control circuit can be set to provide no control signal via the seventh link 558 when the control circuit first begins operating.)

Assuming that the control circuit 556 and driver circuit 554 do operate as described above, it can be appreciated that a user can control the activation/deactivation status of the food waste disposer 104 simply by pressing the disposer activation button 220 to switch the disposer on when it is currently off, as well as by pressing the button to switch the disposer off when it is currently on. For example, if one supposes that the food waste disposer 104 is initially off, this would correspond to an initial state of the relay 524 in which the NO switch 526 is open, such that power is not being provided to the food waste disposer electrical component 502. Such a circumstance would correspond to an initial state of the control PCB 506 in which the control circuit 556 is providing no control signal to the driver circuit 554, such that no voltage is being provided by the driver circuit via the fourth link 540 to the relay 524.

Given such an initial state, a user could cause the food waste disposer 104 to be activated by pressing the disposer activation button 220. The pressing of the disposer activation button 220 in this circumstance would cause a coupling of the first and second terminals 544 and 546 and consequent providing of an actuation signal via the fifth link 550 to the control circuit 556. The control circuit 556 in turn would cause a non-zero control signal to be provided to the driver circuit 554 by way of the seventh link 558, which would provide a voltage to the relay 524 via the fourth link 540. The providing of this voltage to the relay 524 would in turn cause the NO switch 526 to become closed, thus causing power to be delivered to the food waste disposer electrical component 502 and thereby activating the food waste disposer 104.

Alternatively for example, if one supposes that the food waste disposer 104 is initially on (or has been turned on, as discussed above), this would correspond to an initial state of the relay 524 in which the NO switch 526 is closed, such that power is being provided to the food waste disposer electrical component 502, as well as to an initial state in which the control circuit 556 is providing a non-zero control signal to the driver circuit 554, such that voltage is being provided by the driver circuit to the relay 524. Given such an initial state, a user could cause the food waste disposer 104 to be deactivated by pressing the disposer activation button 220. The pressing of the disposer activation button 220 in this circumstance would cause a coupling of the first and second terminals 544 and 546 and consequent providing of an actuation signal via the fifth link 550 to the control circuit 556. The control circuit 556 in turn would toggle in its state and stop providing any control signal to the driver circuit 554 by way of the seventh link 558. Correspondingly, the driver circuit 554 would cease to provide any voltage to the relay 524, the NO switch 526 would become opened, and power would cease to be available to the food waste disposer electrical component 502, such that the food waste disposer 104 would be deactivated.

Still referring to FIG. 5, it should further be appreciated that in the present embodiment the actuator circuit 510 also is configured to provide a food waste disposer activation status indication to a user by way of a light display on or near the location of the disposer activation button 220. More particularly as shown, the actuator circuit 510 corresponding to the disposer activation button 220 includes not only the switch 542 but also the one or more LED(s) (light emitting diode(s)) 560 that are coupled between the ground port 520 and the third port 515, by way of which the LED(s) are coupled to the fourth link 540. Given this arrangement, when the driver circuit 554 is operating to provide a voltage to the relay 524 such that the NO switch 526 is closed and power is supplied to the food waste disposer electrical component 502, such that the food waste disposer 104 is on, voltage is also provided by way of the fourth link to the LED(s) 560 causing those LED(s) to emit light, which can be recognized by the user as an indication that the food waste disposer 104 is activated. Alternatively, when the driver circuit 554 is not operating to provide any voltage to the relay 524 and consequently power is not being supplied to the food waste disposer electrical component 502, no voltage is provided to the LED(s) 560 and the user is not provided any indication that the food waste disposer 104 is on.

The electrical system 500 shown in FIG. 5 is indicative of one example electrical system that can be implemented in relation to or as part of a waste disposer assembly such as the waste disposer assembly 100 of FIG. 1 (e.g., outside of the food waste disposer 104). Nevertheless, it should be appreciated that the electrical components and interconnections that allow for the food waste disposer 104 activation/deactivation status to be controlled via the disposer activation button 220 can take a variety of forms depending upon the embodiment, and that any of a variety of other components and connections differing from those shown in FIG. 5 can also be implemented. For example, the switch 542 within the actuator circuit 510 can take any of a variety of forms depending upon the embodiment. Further for example, in one embodiment, the switch 542 can take the form of a piezoelectric switch. Also for example, in alternate embodiments, the switch 542 can take the form of (or employ) any of a pushbutton with or without LEDs, a rocker, or a tactile/snap dome.

Additionally, even though all of the links/connections shown in FIG. 5 are intended to be wired (e.g., hardwired) connections, it is possible in other embodiments that one or more of these links/connections can be wirelessly achieved. For example, in some other embodiments encompassed herein, a food waste disposer assembly can be configured so that an activation switch on a sprayer mechanism (e.g., corresponding to the switch 542 on the sprayer mechanism 110) can wirelessly activate a food waste disposer of the food waste disposer assembly. Further for example, in some such embodiments, such wireless activation of the food waste disposer by a switch on a sprayer mechanism can be achieved by way of a receiver embedded in the food waste disposer. Additionally, in some such embodiments, such wireless activation can be achieved without any controller (such as that afforded by the control circuitry of the control printed circuit board (PCB) 506 of FIG. 5), or without any controller being provided in addition to (or outside of) the food waste disposer.

More particularly, with respect to the embodiment of FIG. 5, it is intended that the actuator circuit 510 is provided on the wand 200 of the sprayer mechanism 110, that the control PCB 506 is located somewhere on, under, or near the sink 102 (e.g., under the edge 112), and that the actuator circuit 510 is coupled to the third port 515 of the control PCB by way of wired connections. Indeed, as additionally illustrated by FIG. 5, the respective connections between the third port 515 and each of the first terminal 544, the second terminal 546, and the LED(s) 560, and more particularly between the respective fifth link 550, sixth link 552, and fourth link 540 and each of the first terminal 544, the second terminal 546, and the LED(s) 560, can respectively be achieved via a first, second, and third wired connections 562, 564, and 566, respectively. Further, each of the first, second, and third wired connections 562, 564, and 566 can be run together in the form of a bus 568 between the actuator circuit 510 and the control PCB 506 that can run along (and potentially be encased within or as part of) the sprayer housing 212 between the upper end 214 and bottom portion 204, and further along the water hose assembly 113 linking the sprayer hose connection 215 with a water source location. The bus 568 in the present embodiment can be provided as, or as part of, the power/LED wire 294 of the water hose assembly 113 already described above in relation to FIGS. 1, 2A, 2B, 3, 4A, and 4B.

Notwithstanding the above description relating to FIG. 5, it should be appreciated that in other example embodiments the actuator circuit 510 can be coupled to the control PCB 506 by way of wireless connections. In some such embodiments, the water hose assembly by which water is provided to the wand 200 of the sprayer mechanism 110 (e.g., by way of the flexible water hose 290) need not include any power/LED wire such as the power/LED wire 294. Also, in other embodiments, one or more portions of the control PCB 506, such as the control circuit 556, can be provided on the sprayer mechanism 110 rather than at a location under the sink 102 or otherwise apart from the sprayer mechanism. Further, in other embodiments, one or more portions of the control PCB 506, such as the relay 524, can be provided on the waste disposer 502 rather than at another location physically separate from the waste disposer.

Further with respect to alternate embodiments employing wireless connections, in one example embodiment of the electrical system 500, the actuator circuit 510 additionally includes a wireless transceiver 570 (shown in phantom in FIG. 5) and the control PCB 506 also includes a wireless transceiver 572 (also shown in phantom in FIG. 5) to permit wireless communications between the actuation circuit 510 and the control PCB 506, particularly the control circuit 556 and driver circuit 554 thereof. By virtue of such an arrangement, wireless actuation/control signals can be sent by the wireless transceiver 570 in response to the pressing of the disposer activation button 220 and, upon receipt by the wireless transceiver 572, can in turn cause the control circuit 556 and driver circuit 554 to change a state of the relay 524 so as to determine whether AC power is provided to the waste disposer 502 and thereby cause the waste disposer to be switched on or off. Also in such an arrangement, in response to signals from the driver circuit 554, additional wireless signals can be sent by the wireless transceiver 572 to the wireless transceiver 570 so as to control whether the LED(s) 560 of the actuator circuit 510 emit light as an indication of operational status of the waste disposer 502.

Additionally, notwithstanding the presence of the control PCB 506 in FIG. 5, in still another alternate embodiment the waste disposer 502 itself includes a wireless transceiver 574 (also shown in phantom), or a control circuit including such a transceiver, by which the transceiver 570 is capable of communicating with the waste disposer without the control PCB 506 acting therebetween. In such an alternate embodiment, the waste disposer 502 can itself be equipped with switching circuitry that can cause the waste disposer to be switched on or off depending upon control signals received wirelessly from the actuation circuit 510, via the wireless transceivers 570 and 574. Also, in such an embodiment, the waste disposer 502 can provide feedback signals wirelessly to the actuation circuit 510, via the wireless transceivers, governing whether the LED(s) 560 emit light as an indication of operational status of the waste disposer.

Additionally with respect to such alternate embodiments in which the sprayer mechanism 110 (e.g., the actuation circuit 510 thereof) communicates with intermediate control circuitry such as the PCB 506 and/or the waste disposer 502 (or circuitry or portions thereof) and/or displays an operational status indication by way of lighting device(s) (e.g., the LED(s) 560), it should be appreciated that the sprayer mechanism 110 can receive power to perform such operation in any of a variety of manners. In some such embodiments, the sprayer mechanism includes a battery therein (not shown) for supplying power. Such a battery can be, for example, a disposable/replaceable battery or a rechargeable battery. Additionally, in some such embodiments in which a rechargeable battery is employed, the sprayer mechanism can include a port to which a power cord can be coupled for a short period of time to provide power to the sprayer mechanism for recharging of the battery, or the battery can be charged/recharged by way of a wireless or cordless charging mechanism (e.g., employing inductive coupling).

Further with respect to alternate embodiments employing wireless communications between or among the sprayer mechanism 110 (e.g., the actuation circuit 510 associated therewith), intermediate control circuitry such as the control PCB 506 (or circuitry or portions thereof), and/or the waste disposer 502 (or circuitry or portions thereof), it should be recognized that the present disclosure is intended to encompass any of a variety of embodiments employing any of a variety of different components, devices, communications technologies, protocols, or methodologies so as to achieve such wireless communications. Although the above description mentions the use of the wireless transceivers 570, 572, and/or 574, in some embodiments encompassed herein one or more of these transceivers can merely be transmitters or receivers (e.g., the actuation circuit 510 can employ a transmitter and the control PCB 506 can employ a receiver). Also for example, in some embodiments of the sprayer mechanism, the wireless transceiver 570 can include one or more of the components employed for wireless communications described below in regard to FIG. 10.

In some embodiments encompassed herein, one or more of the wireless transceivers 570, 572, and/or 574 can for example be non-cellular transceivers or Wi-Fi transceivers, or even cellular transceivers. Further for example, if one or more of the transceivers are non-cellular transceivers, such transceivers can employ technologies such as Bluetooth, ZigBee, HomeRF (radio frequency), Home Node B (3G femtocell), or even infrared technology. Additionally for example, if Wi-Fi transceivers are employed, such transceivers can be wireless local area network (WLAN) transceivers that operate in accordance with standards such as IEEE 802.11 (a, b, g or n). Also for example, such Wi-Fi transceivers can operate in an ad hoc or peer-to-peer manner (e.g., Wi-Fi Direct). Further for example, in some embodiments the wireless transceivers can achieve any of wide area network (WAN), local area network (LAN), or personal area network (PAN) connections. Additionally for example, if one or more of the transceivers are cellular transceivers, such transceivers can employ any of a variety of cellular-based communications technologies such as, for example, 3G, 4G, 5G, GSM, CDMA, TDMA, GPRS, EDGE, UMTS, WCDMA, CDMA2000, LTE, iDEN, etc.), including both digital and analog communications (e.g., AMPS) technologies, or modified versions thereof.

Further, although the control or communications signals within the electrical system 500 and particularly between the actuation circuit 510 and control PCB 506 can take the form of analog or digital signals, such as high or low (or zero) voltage or current signals (e.g., as described above in regard to FIG. 5), it should also be recognized that in other embodiments the control or communications signals can take other forms. For example, in embodiments employing wireless transceivers such as the wireless transceivers 570, 572, and/or 574, the wireless communications can entail wireless internet communications. Also, in some such embodiments encompassed herein, one or more of the transceivers can be implemented as (or as components of) Internet of Things (IoT) devices that are in wireless communications with one another. Additionally, in some alternate embodiments encompassed herein, including embodiments employing one or more wired or wireless connections between or among the actuation circuit 510 of the sprayer mechanism 110, the control PCB 506 (or other intermediate control circuitry), or the waste disposer 502 (or associated circuitry), such communications can occur by way of the internet or by way of any of a variety of other communication links, such as Ethernet links.

Figure 6:
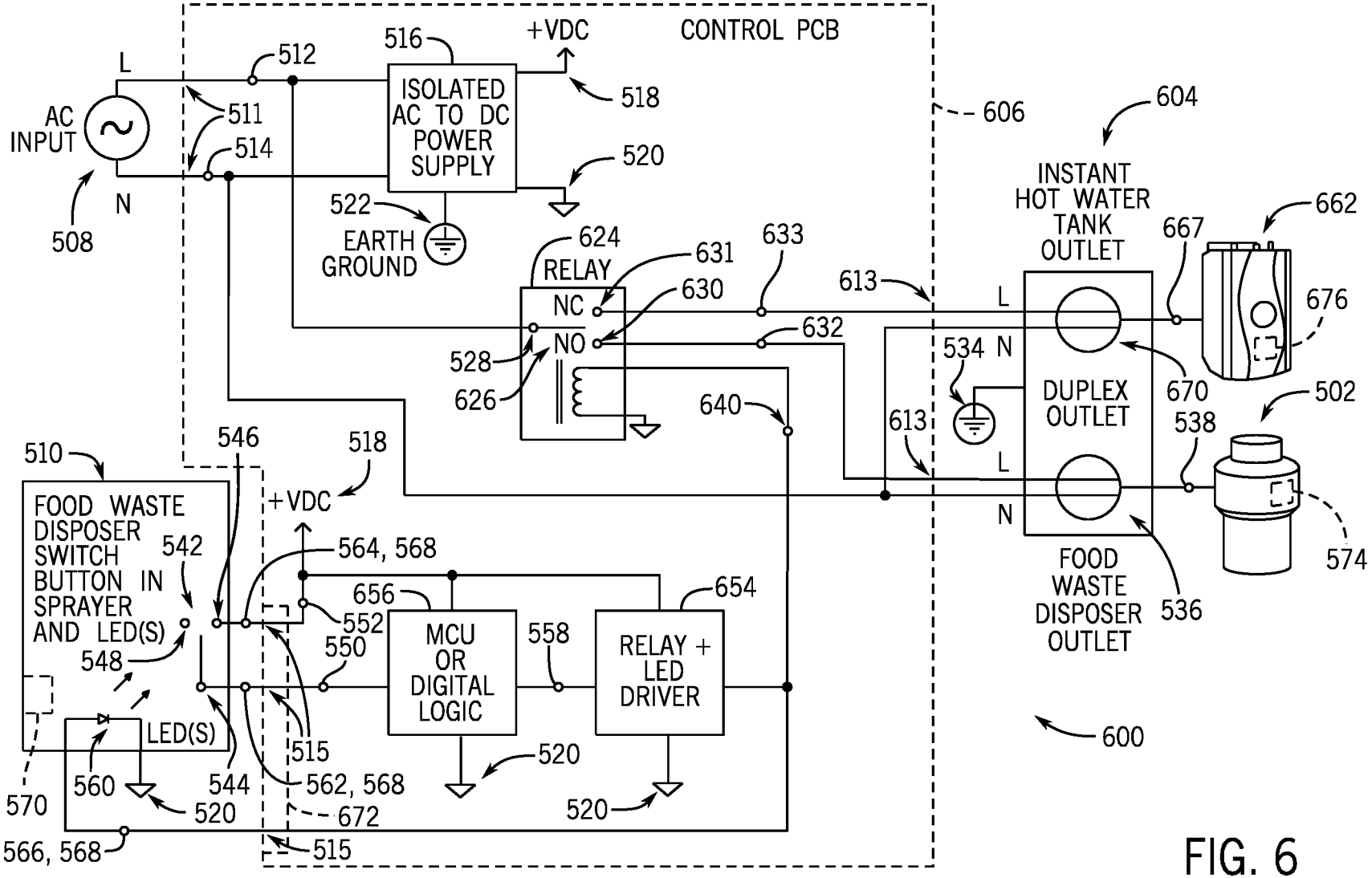
FIG. 6 is an additional electrical schematic diagram showing an alternate embodiment of an electrical system differing from that of FIG. 5, which also can serve as a disposer activation control mechanism.

Turning to FIG. 6, in an alternate embodiment, a modified electrical system 600 can be employed in a waste disposer assembly instead of the electrical system 600. As illustrated, the modified electrical system 600 is particularly suited for implementation as part of a modified waste disposer assembly differing from the waste disposer assembly 100 of FIG. 1 in that the modified waste disposer assembly also includes an instant hot water tank in addition to the food waste disposer 104. In this regard, it can particularly be seen that the modified electrical system 600 of FIG. 6 includes a dual or duplex power outlet 604 instead of the power outlet 504 of FIG. 5 (which takes a single outlet form), and thus accommodates the presence of both the waste disposer assembly electrical component 502 (e.g., the same electric motor discussed in relation to FIG. 5) and a hot water tank electrical component 662 (e.g., a heating unit for a hot water tank).

Further in regard to FIG. 6, it can be appreciated that many of the components and interconnections of the modified electrical system 600 can be identical or substantially similar to the corresponding components and interconnections of the electrical system 500. Indeed, it can be noted that each of the following components or links shown in FIG. 5 are also present in FIG. 6 and can be considered to take the same form and serve the same purpose as discussed above in regard to FIGS. 5: 502, 508, 510, 511, 512, 514, 515, 516, 518, 520, 522, 528, 534, 536, 538, 542, 544, 546, 548, 550, 552, 558, 560, 562, 564, 566, and 568.

However, in contrast in the embodiment of FIG. 5, in the embodiment of FIG. 6, the power outlet 604 (as already noted) is a duplex outlet that additionally includes (in addition to the single or primary outlet 536) a secondary outlet 670, to which the hot water tank electrical component 662 is coupled by way of a power cord 667. Further, to accommodate the providing of power to each of the single outlet 536 and the secondary outlet 670, the modified electrical system 600 includes a modified control PCB 606 that, although the same as the control PCB 506 in many respects (e.g., in terms of the components and links mentioned above), nevertheless differs from the control PCB 506 in some respects.

More particularly in this regard, the control PCB 606 includes a modified relay 624 that differs from the relay 524 of the control PCB 506. As shown, although both of the relays 524 and 624 include the first terminal 528 coupled to the link 512, the modified relay 624 includes both a second, normally-open (NO) terminal 630 and a third, normally-closed (NC) terminal 631, as well as a switch 626 that can switch between coupling the first terminals 528 with either of the terminals 630 or 631. Further, although the single outlet 536 again includes neutral (N) and line (L) ports that are respectively coupled to the link 514 and to the normally-open terminal 630, by way of a link 632, the secondary outlet 670 further includes neutral (N) and line (L) ports that are respectively coupled to the link 514 and to the normally-closed terminal 631, by way of a link 633. Accordingly, the control PCB 606 includes second ports 613 by way of which the neutral and line ports of the single outlet 536 and secondary outlet 670 are coupled to the link 514, the link 632 (and thus the normally-open terminal 630), and the link 633 (and thus normally-closed terminal 631).

Additionally, to accommodate appropriate control of the switch 626 of the relay 624 by way of a voltage provided thereto via a link 640, the driver circuit 554 and control circuit 556 of FIG. 5 are respectively replaced by a driver circuit 654 and control circuit 656. The driver circuit 654 and control circuit 656 can respectively take any of the forms mentioned above with respect to the driver circuit 554 and control circuit 556, but also can be configured to accommodate desired control over the signals provided via the link 640, between the driver circuit 654 and the relay 624.

Thus, in this embodiment of FIG. 6, depending upon the actuation of the disposal activation button 220, one or both of the operational statuses of the food waste disposer and the instant hot water tank can be controlled. Due to the particular configuration of the system, particularly in terms of the coupling of the outlets 536, 670 with respect to the normally-open and normally-closed terminals 630 and 631 of the relay 624, it will be appreciated that this embodiment particularly is configured to activate the hot water tank when the waste disposer assembly is deactivated, or vice-versa. However, in other embodiments, other manners of operation can be achieved.

It should be appreciated that in other example embodiments of the electrical system 600 of FIG. 6, the actuator circuit 510 can be coupled to the control PCB 606 by way of wireless connections. Also, in other embodiments, one or more portions of the control PCB 606, such as the control circuit 656, can be provided on the sprayer mechanism 110 rather than at a location under the sink 102 or otherwise apart from the sprayer mechanism. Further, in other embodiments, one or more portions of the control PCB 606, such as the relay 624, can be provided on the waste disposer 502 (and/or on the hot water tank electrical component 662) rather than at another location physically separate from the waste disposer (and/or the hot water tank electrical component).

Further with respect to alternate embodiments of the electrical system 600 employing wireless connections, in one such example embodiment the actuator circuit 510 can take the same form as was described above as an alternate embodiment in relation to FIG. 5. Again, in such an embodiment, the actuator circuit 510 additionally includes the wireless transceiver 570 (shown in phantom in FIG. 6). In such an alternate embodiment, the control PCB 606 also includes a wireless transceiver 672 (also shown in phantom in FIG. 6) to permit wireless communications between the actuation circuit 510 and the control PCB 606, particularly the control circuit 656 and driver circuit 654 thereof. By virtue of such an arrangement, wireless actuation/control signals can be sent by the wireless transceiver 570 in response to the pressing of the disposer activation button 220 and, upon receipt by the wireless transceiver 672, can in turn cause the control circuit 656 and driver circuit 654 to change a state of the relay 624 so as to change (or otherwise determine) the operational status of the waste disposer 502 and the hot water tank electrical component 662. Also in such an arrangement, in response to signals from the driver circuit 654, additional wireless signals can be sent by the wireless transceiver 672 to the wireless transceiver 570 so as to control whether the LED(s) 560 of the actuator circuit 510 emit light as an indication of operational status of the waste disposer 502.

Additionally, notwithstanding the presence of the control PCB 606 in FIG. 6, in still another alternate embodiment the waste disposer 502 itself includes the wireless transceiver 574 (also shown in phantom in FIG. 6), or a control circuit including such a transceiver, by which the transceiver 570 is capable of communicating with the waste disposer without the control PCB 606 acting therebetween. Likewise, in such an embodiment, the hot water tank electrical component 662 also includes a further wireless transceiver 676 (shown in phantom in FIG. 6), or a control circuit including such a transceiver, by which the transceiver 570 is capable of communicating with that electrical component. In some such cases, the transceiver 570 can also take a modified form to especially accommodate communications with the further wireless transceiver 676.

Further, in such an alternate embodiment, the waste disposer 502 and/or the hot water tank electrical component 662 can each be equipped with respective switching circuitry that can cause the waste disposer and/or hot water tank electrical component to be switched on or off depending upon control signals received wirelessly from the actuation circuit 510, via the wireless transceivers 570, 574, and 676. Also, in such an embodiment, the waste disposer 502 can provide feedback signals wirelessly to the actuation circuit 510, via the wireless transceivers, governing whether the LED(s) 560 emit light as an indication of operational status of the waste disposer. In some such cases, the hot water tank electrical component 662 also can provide feedback signals wirelessly to the actuation circuit 510 (or a modified version thereof) indicative of the operational status of the hot water tank electrical component or associated hot water tank, and allowing a light indication (or other user indication) to be output regarding that status.

Additionally with respect to such alternate embodiments of the electrical system 600 employing wireless communications, it should be appreciated that the sprayer mechanism 110 again can receive power to perform such operation in any of a variety of manners, including those described above concerning alternate embodiments of the electrical system of FIG. 5 involving the use of batteries. Further with respect to alternate embodiments employing wireless communications between or among the sprayer mechanism 110 (e.g., the actuation circuit 510 associated therewith), intermediate control circuitry such as the control PCB 606 (or circuitry or portions thereof), and/or the waste disposer 502 and/or hot water tank electrical component 662 (or circuitry or portions thereof), it should be recognized that the present disclosure is intended to encompass any of a variety of embodiments employing any of a variety of different components, devices, communications technologies, protocols, or methodologies so as to achieve such wireless communications, including any of those described above concerning alternate embodiments of the electrical system of FIG. 5. Therefore, among other things, one or more of the transceivers 570, 672, 574, and 676 can merely be transmitters or receivers. Also, one or more of the wireless transceivers 570, 672, 574 and/or 676 can for example be non-cellular transceivers or Wi-Fi transceivers, or even cellular transceivers, and the control or communications signals within the electrical system can take the form of analog or digital signals, or other forms such as internet-based or Ethernet communication signals.

The present disclosure is intended to encompass numerous different mechanisms and processes for controlling the actuation/operation of food waste disposers and/or hot water tanks. In at least some embodiments, control over the operations of a food waste disposer and instant hot water tank, either by wired or wireless communications, can be understood to proceed as follows. First, AC power connects to a SPDT (single-pole, double-throw) relay. The single-pole connects to the AC power, the normally open relay contact connects to the food waste disposer hot/line input and the normally closed contact connects to the instant hot water tank hot/line input. When the control button is pressed (e.g., the disposer activation button 220), the instant hot water tank is disconnected from AC power, and the food waste disposer is connected to AC power. The food waste disposer then remains connected to AC power, and the instant hot water tank remains disconnected from AC power, even after the control button no longer is pressed (or after it is "let go"), until the control button is pressed again. When the control button is pressed again, the instant hot water tank is again connected to AC power, and the food waste disposer is again disconnected from AC power. The instant hot water tank then remains connected to AC power, and the food waste disposer remains disconnected from AC power, even after the control button no longer is pressed (or after it is "let go"), until the control button is pressed again so as to cause the AC power to be connected again to the food waste disposer and disconnected again from the hot water tank.

In this manner, actuation of the switch by way of the control button causes AC power to toggle between the food waste disposer and hot water tank, in a manner that entails a latching action instead of a momentary action. This allows both the food waste disposer and the hot water tank to run off of a single branch circuit and power receptacle having a single circuit interrupter without overloading that branch circuit. Given this arrangement, the hot water tank typically is powered most of the time (and the hot water tank has its own water temperature control within it that does its own controlling while powered). The hot water can be dispensed manually via a control lever and faucet tap that is separate from the main faucet. However, when the food waste disposer is running, the instant hot water tank is turned off. This is acceptable because the food waste disposer only runs for short periods of time.

It should further be appreciated that the present disclosure is intended to encompass numerous different arrangements in which the control button or actuator takes any of a variety of forms, including disposer activation buttons such as the disposer activation button 220 described above (or disposer activation buttons 320 and 920 described in regard to FIGS. 7, 8, 9, and 10 below) on sprayers/sprayer mechanisms/sprayer heads, or sinktop switch buttons or wireless remote buttons. The present disclosure among other things is also intended to encompass embodiments in which power is controlled, by way of a single button or other actuator, to be provided either to a food waste disposer or alternatively to a hot water tank at any given time based upon the status or most recent actuation of the button or actuator, regardless of the location or type of button or actuator that is actuated (e.g., even if the button or actuator is not positioned on a sprayer as described elsewhere herein).

Figure 8:
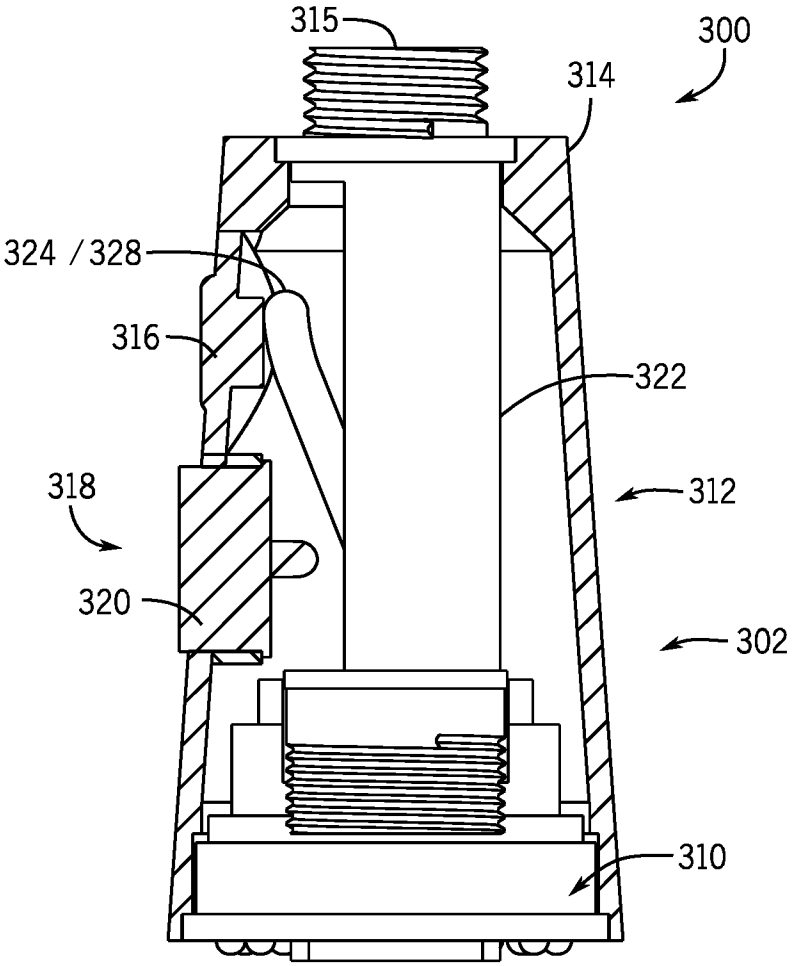
FIG. 8 is a cross-sectional view of the sprayer mechanism of FIG. 7, taken along line 8-8 of FIG. 7
Figure 7:
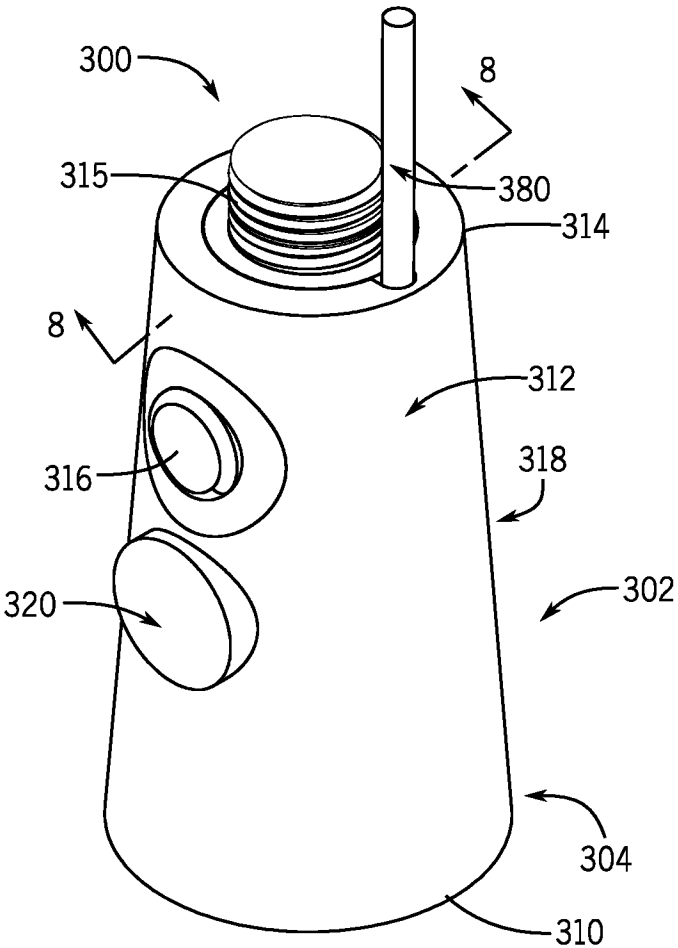
FIG. 7 is a top perspective view of an additional example sprayer mechanism for an improved food waste disposer assembly, in accordance with an additional example embodiment encompassed herein.

While FIG. 1 shows an improved food waste disposer assembly 100 having the sink 102 with the non-extendable faucet 108 and separate sprayer mechanism 110, in accordance with other example embodiments, a sink may utilize a single fixture as both a faucet and a sprayer mechanism. As shown in FIG. 7 and FIG. 8, a combination faucet and sprayer mechanism 300 includes a sprayer head 302 with a sprayer head housing 312 and sprayer outlet 310 at a bottom portion 304 of the sprayer head 302. The upper end 314 of the sprayer head 302 includes a hose connection 315 by which the sprayer head 302 is typically coupled to a water hose (which is not shown in FIGS. 7 and 8, but can for example take a form such as that of the hose 113 of FIG. 1) running through the combination faucet and sprayer mechanism 300, by way of which water is provided to the sprayer head 302 of the combination faucet and sprayer mechanism 300.

It will be appreciated that the combination faucet and sprayer mechanism 300 can be used as a standard faucet, with the sprayer head 302 mounted to the faucet. However, the sprayer head 302 can also be removed from the faucet (not shown) to provide a user with the capability of directing water from the sprayer head 302 toward or at one or more target objects, such as dishware, that may be positioned within the interior region 116 of a sink 102 (with reference to FIG. 1), or at regions of the sink itself that require cleaning.

The sprayer head 302 also includes a water activation button 316. In the present example embodiment, the water activation button 316 is a bulbous structure that protrudes outward from the sprayer head housing 312 at a middle location 318 along the housing between the upper end 314 and bottom portion 304. The water activation button 316 is made from rubber or other flexible material so that a user pressing on the button can deform the button inwardly, so as to actuate in internal valve arrangement. In the present embodiment, the water activation button 316 is configured to cause adjustments in the manner in which water is dispensed from (out of) the sprayer head 302 of the combination faucet and sprayer mechanism 300. More particularly, in the present embodiment, the water activation button 316 governs whether water that is dispensed from the sprayer head 302 has a standard aerated flow or a spray type flow, depending upon whether the button is pressed, or the position of the button.

In other embodiments encompassed herein, a water activation button such as the water activation button 316, and/or one or more additional water activation buttons, on the sprayer head or possibly located elsewhere, can instead or additionally determine other aspects of the operation of the combination faucet and sprayer mechanism 300. For example, in some other embodiments, one or more additional water activation button(s) on the sprayer head can determine whether water is able to flow out of the sprayer head or whether water flow from the sprayer head is completely shut off. Also, in some additional embodiments, a water activation button such as the water activation button 316 can, depending upon its actuation status, change the spraying pattern of the sprayer head 302 (e.g., from a wide spray pattern to a narrow spray pattern). Additionally, in further embodiments encompassed herein, the water flow through the sprayer head 302 may be activated by a different structure (e.g., a button or other structure on the base of the faucet) and the water activation button 316 positioned on the sprayer head 302 may be configured to adjust the manner of water flow (again, for example, between standard aerated flow or spray type flow). In still further embodiments, the water activation button 316 may be a toggle-style switch or lever button.

Further, as shown in the present embodiment, the sprayer head 302 of the combination faucet and sprayer mechanism 300 also includes a disposer activation button 320. As described previously in relation to the disposer activation button 220, a user, by pressing or actuating the disposer activation button 302 can control the activation/deactivation status of the food waste disposer 104 (see FIG. 1), e.g., switch on or switch off the food waste disposer. In the present example embodiment, the disposer activation button 320 is located at a middle location 318 along the housing adjacent to the water activation button 316. Such positioning of the disposer activation button 320 allows a user to conveniently see, feel and access the disposer activation button 320 even when the sprayer head 302 is coupled to the faucet component (not shown).

Referring to FIG. 8 in particular, several features of the sprayer head 302 are evident from the cross-sectional view that is provided, especially in terms of the manner in which the sprayer head 302 operates to dispense water. A sprayer head conduit 322 is formed within the sprayer head housing 312 and connects the hose connection 315 with the sprayer outlet 310. The sprayer head body conduit 322 includes a valve lever 324 and a valve (not shown). The free end 328 of the lever 324 engages with the water activation button 316. It should be appreciated that the lever 324 is so configured to take on an outwardly-projecting position as shown in FIG. 8. When a user presses the water activation button 316 inwardly, the lever 324 is also pushed inward and the valve (not shown) is actuated. In the present example embodiment, depending upon the lever position (and associated valve position), a manner of water flow out of the sprayer head 302 can be adjusted, for example, between standard aerated flow or spray type flow (although in other embodiments one or other operational aspects can be controlled, including for example whether water is at all able to flow out of the sprayer head).

Although perhaps not immediately evident from FIG. 7 and FIG. 8, it should be appreciated that the combination faucet and sprayer mechanism 300, and particularly the sprayer head 302, is designed to allow for a user to move the sprayer head 302 away from its resting position coupled with the faucet portion (not shown), downward and outward away from the faucet portion (not shown), as well as around to different locations within and about the sink 102 (with reference to FIG. 1). The movement of the sprayer head 302 can entail each of vertical movements, horizontal movements, and rotational movements, so as to adjust the location of the sprayer outlet 310, as well as adjust the orientation of the sprayer outlet 310, so as to vary the direction of water flow toward the sink 102 (not shown) and/or towards other structures that may be within or about the sink (including locations outside of the sink).

To facilitate such movement of the sprayer head 302 and still allow for water to be provided to the sprayer head 302 from another location associated with the sink (e.g., a location under the sink), the sprayer hose connection 315 is coupled not to a fixed location but rather is coupled to an end of a hose (which again is not shown in FIGS. 7 and 8, but can for example take a form such as that of the hose 113 of FIG. 1). Depending on the embodiment, the hose can be made of rubber of another flexible material, and will extend some length (e.g., several feet) from the faucet portion (not shown) of the combination faucet and sprayer mechanism 300. It should be appreciated that, when the sprayer head 302 is disengaged from the faucet portion of the combination faucet and sprayer mechanism 300, then the upper end 314 continues to be coupled to a water source because the sprayer hose connection 315 links the sprayer head 302 with that water source by way of the hose, which typically will be arranged so as to extend from the faucet portion (not shown) to greater distances as the sprayer head 302 is moved further from the faucet portion, and to retract back through the faucet portion when the sprayer head 302 is moved closer to the faucet portion or returned to its position coupled with the faucet.

As further mentioned previously, in the present embodiment, the sprayer head 302 not only allows a user to control the dispensing of water out of the sprayer head by way of the sprayer outlet 310, but also affords a user the ability to control the activation/deactivation (e.g., on/off) status of the food waste disposer 104 (see FIG. 1) by way of actuating the disposer activation button 320 on the sprayer head 302. By virtue of the disposer activation button 320, a user can effectively remotely control the activation/deactivation status of the food waste disposer 104 (not shown) by way of a switch that is readily accessible to the user and readily visible to the user when the sprayer head 302 is coupled to the faucet portion of the faucet and sprayer mechanism 300. Further, the disposer activation button 320 also permits a user to effectively remotely control the activation/deactivation status of the food waste disposer 104 (not shown) even when the user is utilizing the sprayer head 302 in a convenient manner when the user is holding the sprayer head 302.

In order for the disposer activation button 320 to permit a user control in relation to the food waste disposer 104 (not shown), the food waste disposer assembly 100 (not shown) includes an electrical system, such as any of the example electrical systems described with respect to FIG. 5 and FIG. 6 (including any of the alternate embodiments of those systems described above such as those employing wireless communications). In the example embodiment shown in FIG. 7, at least a portion of the electrical system (e.g., an actuator circuit) is provided on the sprayer head 302 and the remaining components of the electrical system are provided elsewhere on, under, or near the sink. While communication between the components of the electrical system on the sprayer head 302 and components of the electrical system located elsewhere may be accomplished by wireless means such as described below in regard to FIG. 9 and FIG. 10, it is anticipated that the electrical system will likely use wired connections. Such wired connections 380 run along (and potentially be encased within or as part of) the sprayer head housing 312, and further along the hose (not shown) linking the sprayer hose connection 315 with a water source location.

Figure 10:
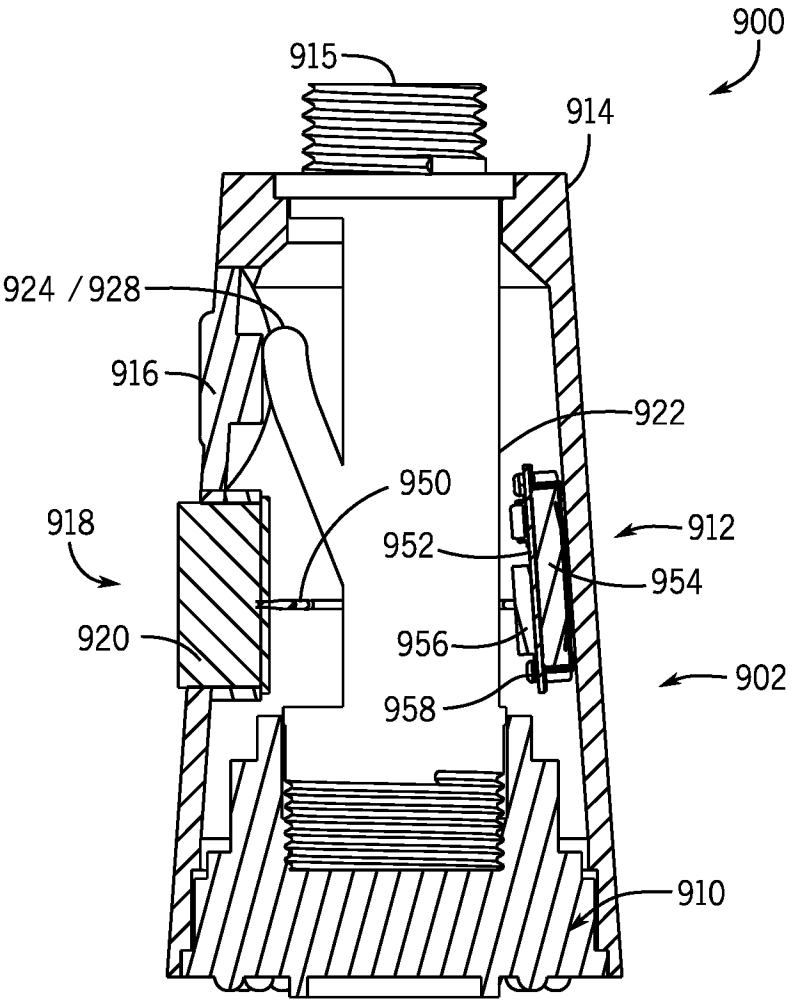
FIG. 10 is a cross-sectional view of the sprayer mechanism of FIG. 9, taken along line 10-10 of FIG. 9.
Figure 9:
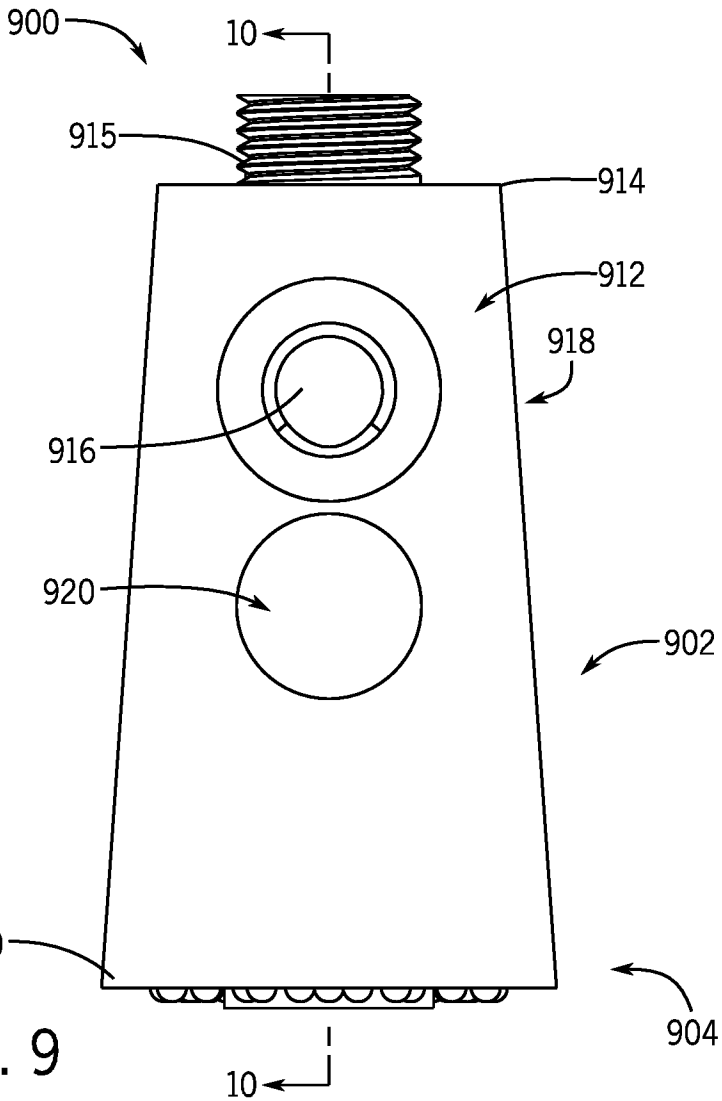
FIG. 9 is a front elevation view of a further example sprayer mechanism for an improved food waste disposer assembly, in accordance with a further example embodiment encompassed herein.

Notwithstanding the above description relating to FIG. 7 and FIG. 8, the present disclosure is also intended to encompass an additional embodiment of a wireless combination faucet and sprayer mechanism 900, a front elevation view of which is shown in FIG. 9 and a cross-sectional view of which (taken along a line 10-10 of FIG. 9) is shown in FIG. 10. It should be appreciated from comparisons of FIG. 9 with FIG. 7, and of FIG. 10 with FIG. 8, that a sprayer head 902 of the mechanism 900 is identical to a sprayer head 302 of the mechanism 300, except insofar that the sprayer head 902 includes certain structural differences to allow for wireless communications. Thus, it should be appreciated that the sprayer head 902 includes a bottom portion 904, sprayer outlet 910, sprayer head housing 912, upper end 914, hose connection 915, water activation button 916, middle location 918, disposer activation button 920, sprayer head body conduit 922, valve lever 924, and free end 928 of the valve lever that are respectively identical or substantially identical to the bottom portion 304, sprayer outlet 310, sprayer head housing 312, upper end 314, hose connection 315, water activation button 316, middle location 318, disposer activation button 320, sprayer head body conduit 322, valve lever 324, and free end 328, respectively, of the sprayer head 302. However, in contrast to sprayer head 302, the sprayer head 902 lacks the wired connections 380. Instead, the sprayer head 902 has several components that allow for wireless communications that include a wireless printed circuit board (PCB) 952, coin cell battery 954, radio frequency (RF) module 956, and an antenna 958 supported within the interior of the sprayer head housing 912, as well as a disposer activation button to PCB wire 950 linking the disposer activation button 920 to the PCB 952 so that electrical signals indicative of the position/movement of the disposer activation button are received by the PCB 952. By virtue of the PCB 952, battery 954, RF module 956, and antenna 958, wireless signals can be communicated between the sprayer head 902 and an external circuit such as one of the PCBs 506 or 606 described above.

In at least some embodiments encompassed herein (including, for example, certain example embodiments corresponding to those described above in regard to any of FIG. 5, FIG. 6, FIG. 9, and FIG. 10), wireless communications (and associated wireless switching) can be achieved by way Bluetooth Low Energy (BLE) wireless technology. In some such embodiments, the disposer activation button (e.g., the disposer activation button 220 or 920) on the sprayer head or sprayer mechanism will have a dual function—activation initiation and Bluetooth pairing initiation. In such embodiments, a first step will be to pair the sprayer (sprayer head or sprayer mechanism) with the wireless control box or with the wireless PCB inside the food waste disposer (e.g., with one of the PCBs 506 and 606 of FIG. 5 and FIG. 6). Bluetooth pairing is a form of information registration for linking devices. By registering device information (pairing) between devices, the devices can connect (to use a Bluetooth device relative to another Bluetooth device, the devices should first be paired). For example, to pair devices, starting from the "disposer off" state, the button on the sprayer would be depressed and held for 5 seconds to enter pairing mode. Pairing mode would be indicated by a flashing lighting device (e.g., LED) on the disposer activation button of the sprayer. Then, a corresponding pairing button on the wireless control box or food waste disposer (e.g., wireless PCB associated therewith) would be pressed for 5 seconds to enter pairing mode for that device. This pairing activation would also be indicated by a flashing LED (e.g., at the wireless control box or food waste disposer). When the two paired devices (or sides) are successfully linked/connected (that is, when the sprayer is successfully linked/connected with the control box or food waste disposer), then the LEDs on both paired devices would illuminate continuously without flashing for 3 seconds. Further, after the two sides are paired, the button on the sprayer will operate as an activation button for the food waste disposer. That is, as a second step of operation (following the first, pairing step), when the sprayer button pressed for less than 5 seconds, the food waste disposer is activated. When the sprayer button is pressed again, the food waste disposer is deactivated.

Further, the present disclosure is intended to encompass still additional embodiments other than or in addition to those described above. For example, the present disclosure is intended to encompass embodiments relating to any of a variety of waste disposers and waste disposer assemblies, including, but not limited to, food waste disposers or food waste disposer assemblies (as well as mechanisms such as pulpers). Also for example, the present disclosure is intended to encompass embodiments in which other types of mechanisms other than waste disposers and/or hot water tanks are controlled. Additionally, the present disclosure is intended to encompass other embodiments in which the control is achieved by way of other mechanisms or actuators than or in addition to a push button, and/or that are located at or on other structures in or around waste disposers. Further, the present disclosure is intended to encompass additional embodiments in which other types of operational status are controlled or influenced, including for example other statuses of the waste disposers such as the speed of rotation of motors in such disposers.

Accordingly, it is specifically intended that the present invention not be limited to the embodiments and illustrations contained herein, but include modified forms of those embodiments including portions of the embodiments and combinations of elements of different embodiments as come within the scope of the following claims.

We claim:

1. A method of controlling an operational status of a waste disposer supported in relation to a sink, the method comprising:

providing a sprayer mechanism configured to be supportable in relation to the sink, and coupled at least indirectly to the sink by way of an extendable and retractable linkage;

causing water to be dispensed from a water port of the sprayer mechanism in response to a first actuation of a water control actuator;

generating a control signal in response to a second actuation of an actuation mechanism; and sending either the control signal or an additional signal based at least indirectly upon the control signal for receipt by at least one receiving device, wherein the control signal or additional signal that is sent is configured to cause the at least one receiving device to operate to cause the operational status of the waste disposer to change.

2. The method of claim 1, further comprising:

moving the sprayer mechanism in relation to the sink, as permitted by the extendable and retractable linkage, so that the water port of the sprayer mechanism is directed in a desired manner.

3. The method of claim 1, further comprising:

receiving, at the sprayer mechanism, a feedback signal concerning the operational status of the waste disposer.

4. The method of claim 3, further comprising:

outputting a light signal from a lighting device on the sprayer mechanism at least indirectly in response to the feedback signal, the light signal being indicative of the operational status of the waste disposer.

5. The method of claim 1, wherein the control signal or additional signal that is sent is configured to additionally cause the at least one receiving device to operate to cause an additional operational status of a hot water tank to change.

6. A waste disposer assembly, comprising:

a sprayer mechanism, wherein the sprayer mechanism includes a sprayer outlet, and a housing having a water activation button and a disposer activation button; and a waste disposer, wherein the disposer activation button is at least indirectly coupled to the waste disposer and actuating the disposer activation button controls an activation status of the food waste disposer, wherein the sprayer mechanism further comprises:

a wand including the housing, wherein the housing has a bottom portion and an upper end, wherein the bottom portion includes a sprayer hose connection; and a water hose assembly coupled to the sprayer hose connection.

7. The waste disposer assembly of claim 6, wherein the disposer activation button is located at the upper end of the wand of the sprayer mechanism.

8. The waste disposer assembly of claim 6, wherein the sprayer mechanism further comprises a sprayer base.

9. The waste disposer assembly of claim 8, wherein, when in a resting configuration, the bottom portion of the wand fits coaxially within, and is supported by, a complementary receiving orifice of the sprayer base.

10. The waste disposer assembly of claim 6, wherein the water activation button is located on the housing between the upper end and the bottom portion.

11. The waste disposer assembly of claim 6, wherein the assembly further comprises a hot water tank, and actuating the disposer activation button controls an operational status of the hot water tank.

12. A waste disposer assembly, comprising:

a sprayer mechanism having a water activation button and a disposer activation button;

a waste disposer, wherein the disposer activation button is coupled at least indirectly to the waste disposer and actuating the disposer activation button controls an activation status of the food waste disposer; and an electrical system, wherein the electrical system includes:

a waste disposer electrical component that includes a power cord and an electric motor within the waste disposer;

control circuitry provided on a control printed circuit board (PCB) having a first switch and configured to receive first power from a first power source;

a power outlet coupled to the PCB, wherein the waste disposer electrical component is at least indirectly coupled to the power outlet; and an actuator circuit coupled to the PCB;

wherein, when the first switch has a first status, the first power from the first power source is provided to the power outlet and to the food waste disposer electrical component, such that the food waste disposer is activated, and when the first switch has a second status, the food waste disposer electrical component does not receive the first power and the food waste disposer is deactivated.

13. The waste disposer assembly of claim 12, wherein the sprayer mechanism further comprises a housing having a bottom portion and an upper end, a sprayer hose connection positioned either at the bottom portion or the upper end and a water hose assembly coupled to the sprayer hose connection, and further comprising a hot water tank that is coupled at least indirectly to the PCB and that is activated when the food waste disposer is deactivated.

14. A waste disposer assembly, comprising:

a sprayer mechanism, wherein the sprayer mechanism includes a sprayer outlet, and a housing having a water activation button and a disposer activation button; and a waste disposer, wherein the disposer activation button is at least indirectly coupled to the waste disposer and actuating the disposer activation button controls an activation status of the food waste disposer, wherein the sprayer mechanism further comprises:

a sprayer head, the sprayer head including the housing, a sprayer outlet disposed at a bottom portion of the sprayer head, and a hose connection disposed at an upper end of the sprayer head.

15. The waste disposer assembly of claim 14, wherein the sprayer head further comprises:

a printed circuit board (PCB);

a radio frequency (RF) module;

a battery; and an antenna.

16. The waste disposer assembly of claim 14, wherein the sprayer head further comprises a disposer activation button to printed circuit board (PCB) wire linking the disposer activation button to the PCB such that electrical signals indicative of a position of the disposer activation button are received by the PCB.

17. A waste disposer assembly, comprising:

a sprayer mechanism, wherein the sprayer mechanism includes a sprayer outlet, and a housing having a water activation button and a disposer activation button; and a waste disposer, wherein the disposer activation button is at least indirectly coupled to the waste disposer and actuating the disposer activation button controls an activation status of the food waste disposer, wherein the assembly further comprises a hot water tank, and actuating the disposer activation button controls an operational status of the hot water tank.

18. The waste disposer assembly of claim 17, wherein the hot water tank is activated when the waste disposer is deactivated.

19. A waste disposer assembly, comprising:

a sprayer mechanism, wherein the sprayer mechanism includes a sprayer outlet, and a housing having a water activation button and a disposer activation button; and a waste disposer, wherein the disposer activation button is at least indirectly coupled to the waste disposer and actuating the disposer activation button controls an activation status of the food waste disposer, wherein the disposer activation button includes one or more lighting devices, and the one or more lighting devices emit light when the waste disposer is activated.

20. A waste disposer assembly, comprising:

a sprayer mechanism, wherein the sprayer mechanism includes a sprayer outlet, and a housing having a water activation button and a disposer activation button;

a waste disposer, wherein the disposer activation button is at least indirectly coupled to the waste disposer and actuating the disposer activation button controls an activation status of the food waste disposer; and a switching system coupled at least indirectly to each of the sprayer mechanism and the waste disposer, wherein the switching system includes control circuitry provided on a printed circuit board (PCB) that is configured to receive alternating current (AC) power from an AC power source and that is coupled at least indirectly to a waste disposer electrical component of the waste disposer.

* * * * *